US010347977B1

(12) United States Patent
Kim et al.

(10) Patent No.: US 10,347,977 B1
(45) Date of Patent: Jul. 9, 2019

(54) MULTI-POLARIZATION ANTENNA SYSTEM ON A SINGLE CIRCUIT BOARD

(71) Applicant: Amazon Technologies, Inc., Seattle, WA (US)

(72) Inventors: Namhoon Kim, San Jose, CA (US); Ming Zheng, Santa Clara, CA (US)

(73) Assignee: Amazon Technologies, Inc., Seattle, WA (US)

( * ) Notice: Subject to any disclaimer, the term of this patent is extended or adjusted under 35 U.S.C. 154(b) by 224 days.

(21) Appl. No.: 15/604,290

(22) Filed: May 24, 2017

(51) Int. Cl.

| | |
|---|---|
| ***H01Q 1/48*** | (2006.01) |
| ***H01Q 1/38*** | (2006.01) |
| ***H01Q 1/52*** | (2006.01) |
| ***H01Q 9/04*** | (2006.01) |
| ***H01Q 1/12*** | (2006.01) |
| ***H01Q 25/00*** | (2006.01) |

(52) U.S. Cl.
CPC ..... *H01Q 1/38* (2013.01); *H01Q 1/1242* (2013.01); *H01Q 1/48* (2013.01); *H01Q 1/521* (2013.01); *H01Q 9/0478* (2013.01); *H01Q 25/001* (2013.01)

(58) Field of Classification Search
CPC ..... H01Q 1/38; H01Q 1/242; H01Q 1/48; H01Q 1/521; H01Q 9/0478
USPC ..... 343/848
See application file for complete search history.

(56) References Cited

U.S. PATENT DOCUMENTS

| | | | | |
|---|---|---|---|---|
| 2010/0013730 | A1* | 1/2010 | Azhari | H01Q 1/243 343/848 |
| 2010/0141548 | A1* | 6/2010 | Quintero Illera | H01Q 1/36 343/848 |
| 2010/0245198 | A1* | 9/2010 | Wilson | H01Q 1/243 343/767 |
| 2011/0068995 | A1* | 3/2011 | Baliarda | H01Q 9/0421 343/848 |
| 2012/0262343 | A1* | 10/2012 | Radojkovic | H01Q 1/48 343/702 |
| 2015/0162663 | A1* | 6/2015 | Boryssenko | H01Q 9/0478 343/848 |
| 2015/0357714 | A1* | 12/2015 | Ng | H01Q 1/48 343/848 |
| 2017/0365910 | A1* | 12/2017 | Zachara | H01Q 5/50 |

* cited by examiner

*Primary Examiner* — Huedung X Mancuso
(74) *Attorney, Agent, or Firm* — Lowenstein Sandler LLP

(57) ABSTRACT

Antenna structures and methods of operating the same of an electronic device are described. One apparatus includes a circuit board and an antenna having a ground element disposed on the circuit board. A ground-extension bracket is coupled to the ground element and oriented orthogonally to the circuit board. The antenna further includes a radiating element disposed on the circuit board and oriented linearly with respect to the ground-extension bracket. The antenna, in response to a radio frequency (RF) signal, is configured to radiate electromagnetic energy in a radiation pattern at an angle of polarization with respect to a plane of the circuit board, where the angle of polarization is acute and angled towards the ground-extension bracket.

20 Claims, 17 Drawing Sheets

(Reflection)

(Diffraction)

(Scattering)

Two Kinds of Linear Polarization

MULTI-POLARIZATION ANTENNA SYSTEM ON A SINGLE CIRCUIT BOARD

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

BRIEF DESCRIPTION OF DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1A:
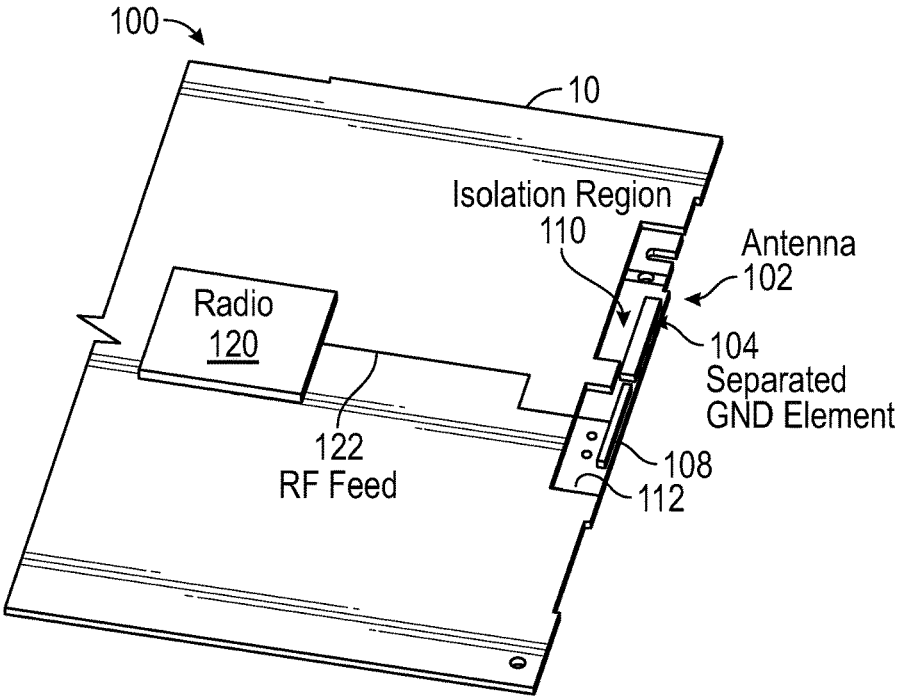
FIG. 1A is a perspective view of an antenna architecture disposed on a printed circuit board (PCB) of a user device according to one embodiment.

Antenna structures and methods of operating the same of an electronic device are described. One apparatus includes an antenna having a ground element disposed on a circuit board that takes up less than all of the surface area of the circuit board. A ground-extension bracket, coupled to the ground element, is oriented orthogonally to the circuit board and is to extend the electromagnetic coverage of the ground element into a space above the circuit board. A radiating element is disposed on the circuit board, the radiating element oriented linearly with respect to the ground-extension bracket. In response to a radio frequency (RF) signal, the radiating element is configured to radiate electromagnetic energy in a radiation pattern at an angle of polarization with respect to a plane of the circuit board, due to the orientation of the ground-extension bracket with respect to the radiating element. The angle of polarization may be an acute angle directed towards the ground-extension bracket, e.g., not an angle that is either vertical or horizontal with respect to the plane of the circuit board.

In most user devices containing a circuit board, the ground on the circuit board is a ground plane that covers the entirety of the circuit board. In a user device that includes more than one antenna structure, the antenna structures share the ground plane as the source of ground. This shared ground plane may prevent, or may make difficult, the control of polarization of the radiation pattern caused by the antenna structures disposed on the circuit board. For example, a resonating structure disposed in a horizontal plane above the ground plane of a PCB causes the radiation of electromagnetic energy to be in a horizontal polarization in the radiation pattern. A vertical polarization within the radiation pattern can be achieved by orienting a resonating structure orthogonal with respect to the ground plane.

Because radiating structures of MIMO architecture are usually formed on the horizontal surface of the circuit board, MIMO antennas have dominate horizontal polarization. But, as linearly-polarized waves (whether horizontal or vertical) pass through indoor wireless propagation environments, they undergo reflection, diffraction, and scattering off of metallic and dielectric objects. These reflected waves have changes in polarization and thus may no longer be truly linear, undergoing unexpected polarization mismatch loss. More particularly, mismatch loss occurs when two electromagnetic fields with different linear polarizations co-exist. The disclosed antenna employs a separate ground element with a ground-extension bracket that provides for changing the angle of polarization. The resultant radiation pattern from a pair of antennas radiating at the same frequency is a multi-polarized (e.g., cross-polarized) radiation pattern that experiences less mismatch loss then linearly-polarized radiation patterns.

The difficulty in controlling polarization of a radiation pattern of an antenna structure compounds the challenges faced by antenna engineers in constrained radiation spaces (low and thin profiles for mobile devices) of user devices. One challenge is antenna diversity (also referred to as spatial diversity) to ensure wireless connectivity over channel fading caused by multipath and null spots of the antenna radiation pattern. To achieve the benefit of antenna diversity, a low envelope correlation coefficient (ECC) is needed. Traditionally, low ECC may be obtained by two or more antennas located in different orientations and/or locations. In such cases, more antenna space is needed to accommodate the additional antennas needed for a low ECC for antenna diversity. It is difficult, however, to obtain low ECC with co-located antennas or closely coupled antennas, particularly without the ability to control polarization of electromagnetic radiation of co-located antennas.

The embodiments described herein are further directed to multi-polarization antennas radiating electromagnetic energy at approximately the same frequency, or in MIMO architecture, at more than one frequency. To achieve multi-polarization between a pair of antennas radiating at the same frequency, a first antenna is configured to radiate electromagnetic energy in a first radiation pattern at a first angle of polarization with respect to the circuit board and a second antenna is configured to radiate electromagnetic energy in a second radiation pattern at a second angle of polarization with respect to the circuit board, where the combination of the first radiation pattern and the second radiation pattern collectively form a multi-polarization radiation pattern. In one embodiment, the first antenna radiates at either a horizontal polarization or a vertical polarization, and the second antenna radiates at an acute angle of polarization with respect to the horizontal polarization or the vertical polarization. In another embodiment, both the first angle of polarization and the second angle of polarization are acute angles with respect to the circuit board and angled towards a corresponding ground-extension bracket. In this case, when both angles of polarization are 45 degrees, the antennas radiate to collectively form a cross-polarization radiation pattern. This particular example of a cross-polarization pattern may provide an approximate 3 dBm improvement in radiation power as compared with horizontal polarization, as will be discussed in more detail.

Additional embodiments described herein are directed at changing the current flow within the ground-extension bracket that is coupled to the ground element, to adjust the angle of polarization of the corresponding antenna. In one embodiment, the ground-extension bracket may include one or more horizontal slots, each alternating and passing at least to (or beyond) the middle of the ground-extension bracket. A switch is coupled across each horizontal switch and includes a state (e.g., on or off). A processing device, also disposed on the circuit board and electronically coupled to each switch via control lines, may control the switches to set a state of each switch. The combination of states of the switches on the ground-extension bracket may correlate to a predetermined angle of polarization by manipulating the current flow within the ground-extension bracket. In this way, behavior of the disclosed ground-extension bracket may be manipulated to control the angle of polarization at which any of the disclosed antennas radiates electromagnetic energy with respect to the circuit board. The result is to lower the ECC of a pair of antennas and provides for a higher radiation power in the resultant multi-polarization radiation pattern.

The antenna structures described herein can be used for Long Term Evolution (LTE) frequency bands, third generation (3G) frequency bands, Wi-Fi® and Bluetooth® frequency bands or other wireless local area network (WLAN) frequency bands, wide area network (WAN) frequency bands, global navigation satellite system (GNSS) frequency bands (e.g., global positioning system (GPS) frequency bands), or the like.

FIG. 1A is a perspective view of an antenna architecture disposed on a printed circuit board (PCB) 10 of a user device 100 according to one embodiment. The user device 100 includes an antenna 102, a radio 120, and an RF feed 122. The radio 120 by be a radio frequency (RF) chipset, an RF module (e.g., WLAN module, which in one embodiment employs Wi-Fi®), or other processing device that employs wireless transmission and reception technology. The antenna 102 may include a separated ground element 104 disposed on the PCB 10. A radiating element 108 may be disposed on the PCB 10 such that the radiating element 108 is oriented linearly with respect to a length of the ground-extension bracket 114 and within the same plane as the ground-extension bracket. As depicted, the separated ground element 104 and the radiating element 108 may be aligned along an edge of one side of the PCB 10.

In various embodiment, the PCB 10 may form one or more isolation regions 110 and 112 made of a dielectric (such as silicon dioxide, silicon nitride, air, or the like) as an antenna keep-out zone around, respectively, the separated ground element 104 and the radiating element 108. The PCB 10 may have a ground plane that is separate from the separated ground element 104 by the isolation regions 110 and 112. These isolation regions 110 and 112 may provide a minimum distance (e.g., approximately 10 millimeters or greater) between the ground plane of the PCB and the antenna 102 within which the antenna 102 (with separated ground element 104) has to radiate and detect electromagnetic energy for proper operation. In one embodiment, the isolation regions 110 and 112 are combined into a single isolation region encompassing both the separated ground element 104 and the radiating element108. The antenna 102 may radiate a horizontal radiation pattern of electromagnetic energy in response to receipt of an electromagnetic signal from the radio 120 through the RF feed 122.

Figure 1B:
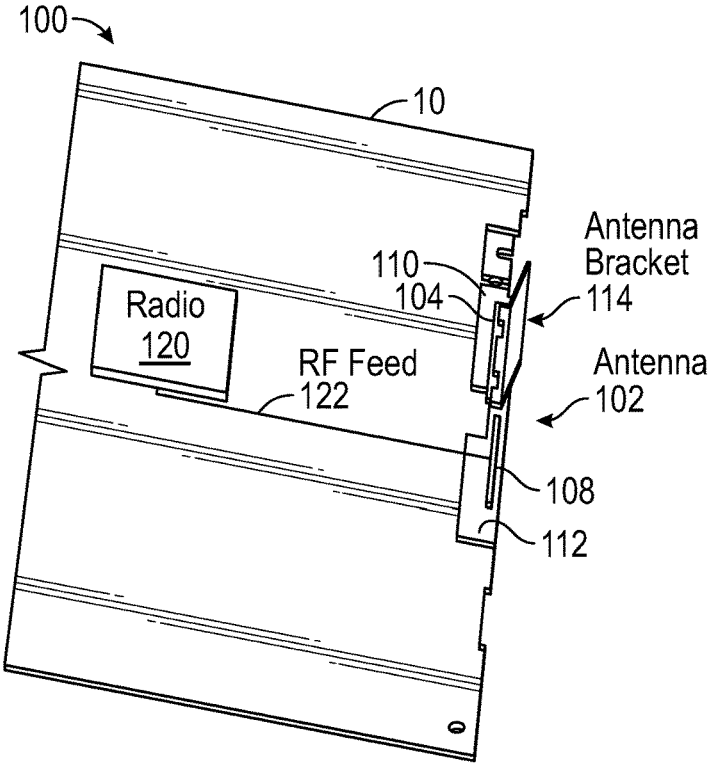
FIG. 1B is a perspective view of the user device of FIG. 1A with a ground-extension bracket attached to a separated antenna ground element according to one embodiment.

FIG. 1B is a perspective view of the antenna 102 of FIG. 1A with a ground-extension bracket 114 attached to the separated ground element 104 according to one embodiment. The ground-extension bracket 114 may contain a flared bottom portion that may be attached to the separated ground element 104, to thereby provide the extension of the ground element 104 into a space above the PCB 10. By providing this ground extension, the angle of polarization at which the radiating element 108 radiates electromagnetic energy is pulled towards the ground-extension bracket 114, e.g., clockwise with the perspective of looking at the PCB 10, and thus moving away from being a horizontal radiation pattern. As will be discussed in more detail, therefore, with a change to the configuration and current flow of the ground-extension bracket 114, the polarization of the radiation pattern of the antenna 100 may also be adjusted to a different angle of polarization with respect to the PCB 10. Furthermore, the height of the ground-extension bracket 114 may be set for a particular frequency (e.g., 2.4 GHz or 5 GHz, or any frequency between about 800 MHz and 5 GHz), and may also impact the angle of polarization of the radiation pattern at which the antenna radiates electromagnetic energy.

Figure 2A:
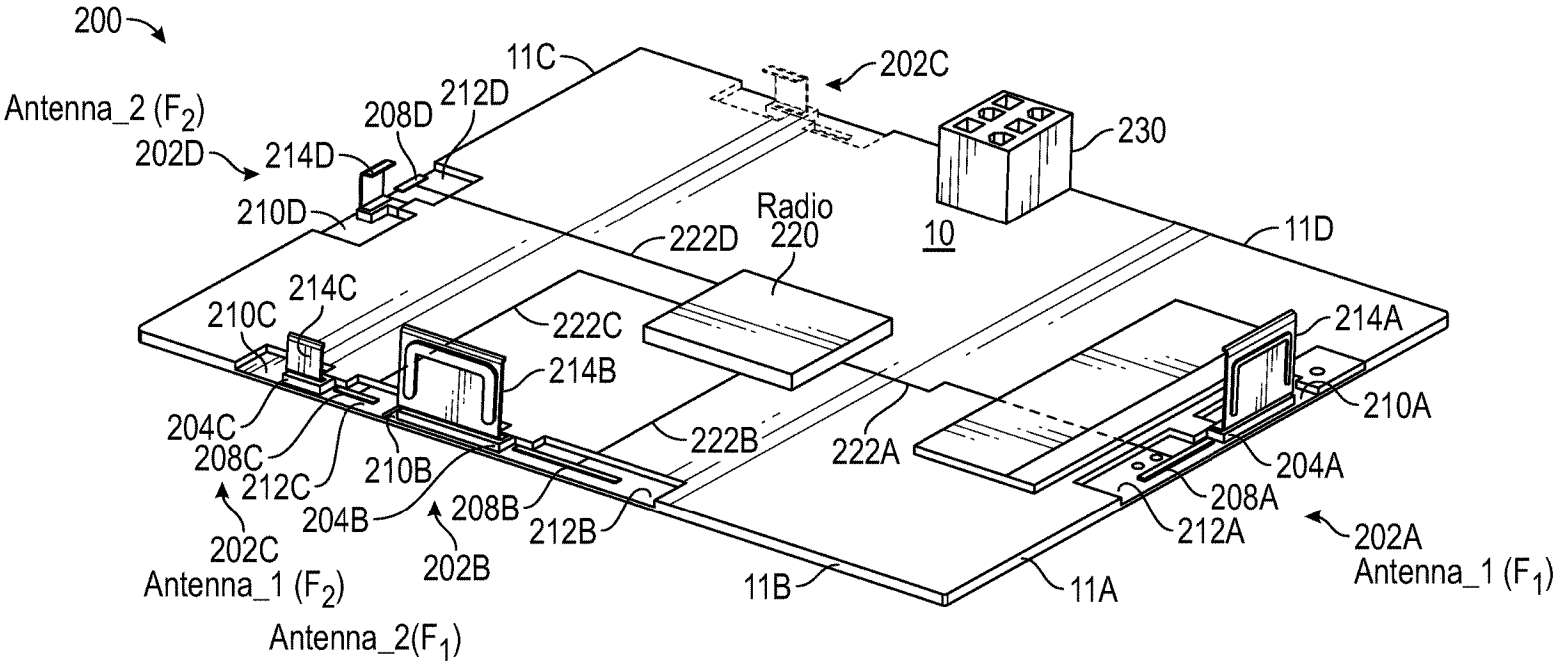
FIG. 2A illustrates is a perspective view of a user device including two sets of antennas disposed on a PCB in a multiple-input-multiple output (MIMO) architecture according to various embodiments.
Figure 2B:
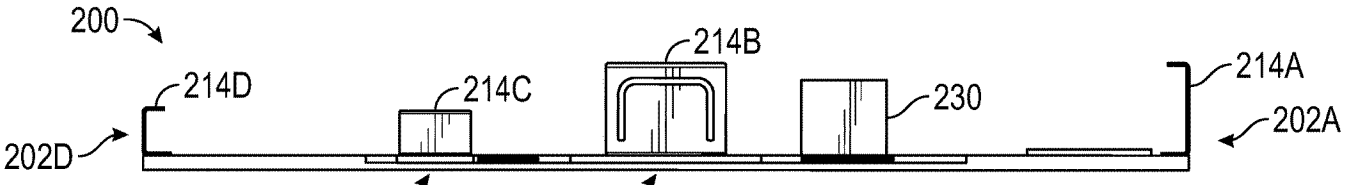
FIG. 2B illustrates a side view of the PCB of FIG. 2A according to various embodiments.
Figure 2C:
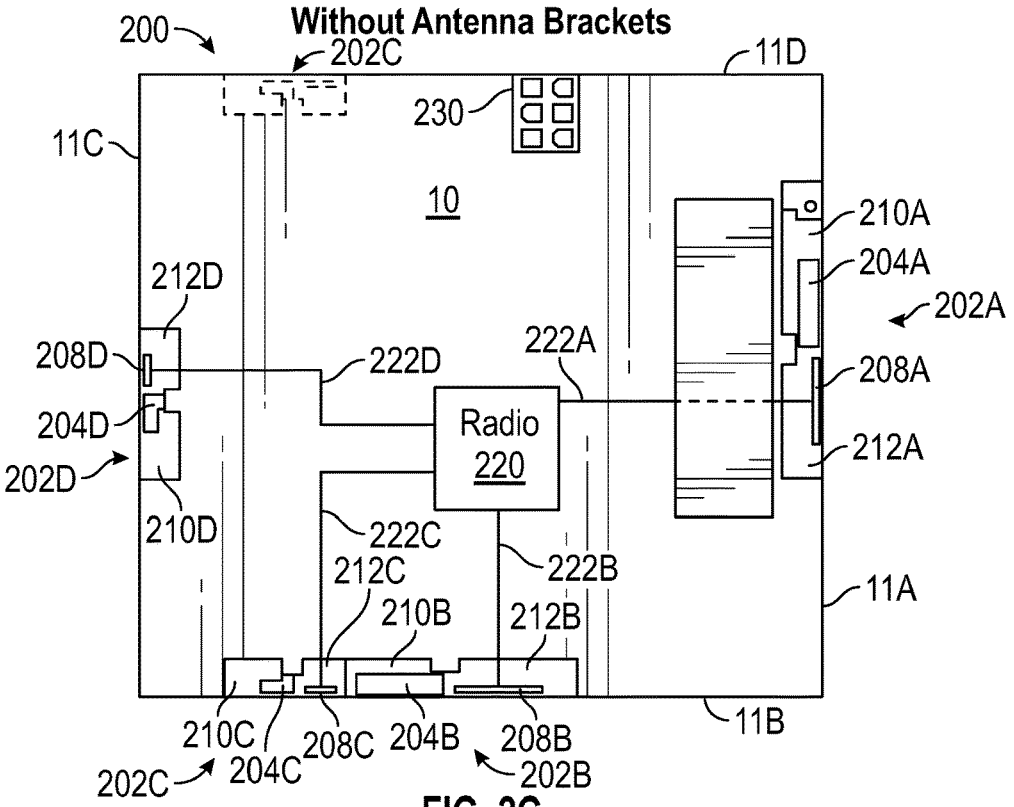
FIG. 2C illustrates a top view of the PCB of FIG. 2A without ground-extension brackets according to various embodiments.
Figure 2D:
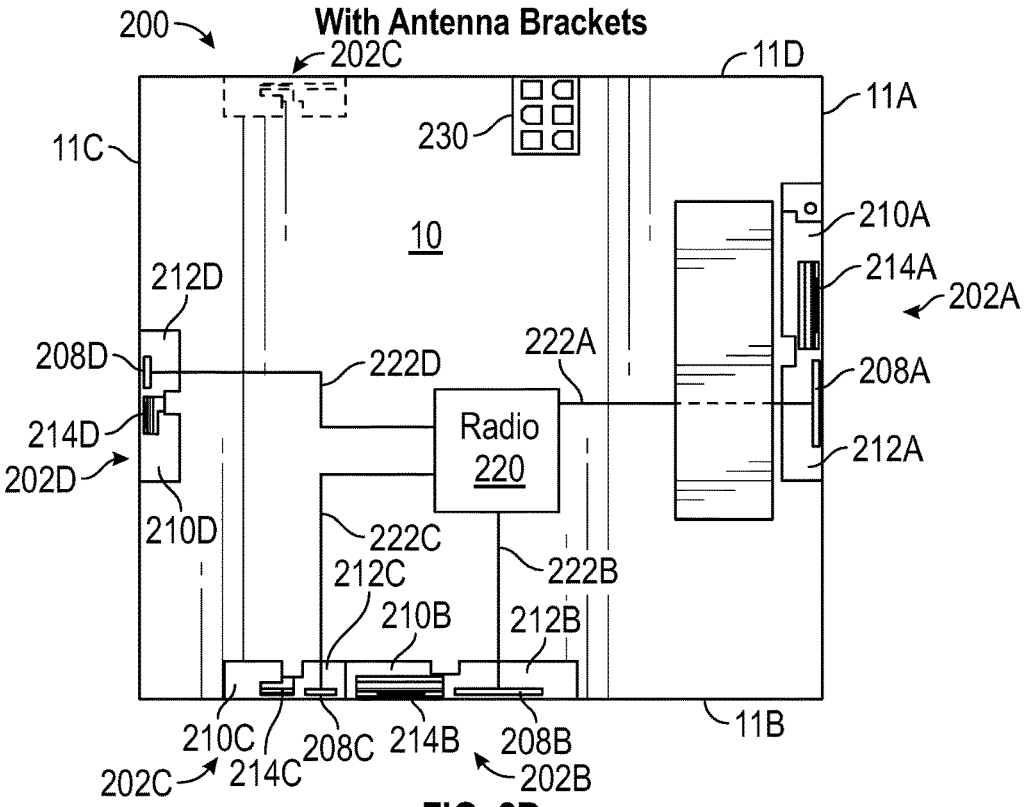
FIG. 2D illustrates a top view of the PCB of FIG. 2A with ground-extension brackets attached according to various embodiments.

FIG. 2A illustrates is a perspective view of a user device 200 including two sets of antennas disposed on a PCB 10 in a multiple-input-multiple output (MIMO) architecture according to various embodiments. FIG. 2B illustrates a side view of the PCB 10 of FIG. 2A. While FIG. 2C illustrates a top view of the PCB 10 of FIG. 2A without ground-extension brackets, FIG. 2D illustrates a top view of the PCB 10 of FIG. 2A with disposed ground-extension brackets according to various embodiments. The user device 200 may also include a radio 220, which may be similar to the radio 120 introduced in FIG. 1A, and a power port 230. The two sets of antennas, which may be WLAN antennas in various embodiments, may include a first set of antennas that radiate electromagnetic energy at a first frequency ($F_1$) and a second set of antennas that radiate electromagnetic energy at a second frequency ($F_2$). Each antenna may be arranged similarly as discussed with reference to FIGS. 1A and 1B, with various mutual arrangements between components of the antennas and between the antennas themselves providing various embodiments. In a common commercial embodiment, the first frequency ($F_1$) is 2.4 GHz and the second frequency ($F_2$) is 5 GHz, although these frequencies are merely exemplary and by no way limiting of possible frequencies, which may also be selected from a range between approximately 2.4 GHz and 5 GHz.

In various embodiments, a first antenna 202A that radiates at the first frequency may include a first ground element 204A, a first ground-extension element 214A, a radiating element 208A, a first isolation region 210A, and another first isolation region 212A. A first RF feed 222A may be coupled between the radio 220 and the first radiating element 208A, e.g., as a dipole antenna. The first antenna 202A may be disposed along a first edge 11A of the PCB 10, e.g., along an edge of the first edge 11A. The first ground-extension element 214A may be physically coupled to the PCB 10 and electrically coupled to the first ground element 204A. The first ground-extension bracket 214A extends from the PCB 10 in a second plane that is orthogonal to a first plane of the PCB. The first radiating element 208A is disposed on the PCB 10 and coupled to the first RF feed 222A. The first radiating element 208A is oriented linearly with respect to a length of the first ground-extension bracket 214A within the second plane, e.g., corresponding to a line formed by the edge of the first edge 11A of the PCB. The radio 220, upon applying a first signal to the RF feed, causes the first radiating element 208A to radiate electromagnetic energy in a first radiation pattern.

With further reference to FIGS. 2A, 2B, 2C, and 2D, a second antenna 202B that radiates at the first frequency may include a second ground element 204B, a second ground-extension element 214B, a second radiating element 208B, a second isolation region 210B, and another second isolation region 212B. A second RF feed 222B may be coupled between the radio 220 and the second radiating element 208B. The second antenna 202B may be disposed along a second edge 11B of the PCB 10, e.g., along an edge of the second edge 11B. The second ground-extension bracket 214B may be physically coupled to the PCB 10 and electrically coupled to the second ground element 204B. The second ground-extension bracket 214A extends from the PCB in a third plane that is orthogonal to the first plane of the PCB and to the second plane of the first ground-extension bracket 214A. The second radiating element 208B is disposed on the PCB 10 and coupled to the second RF feed 222B. The second radiating element 208B is oriented linearly with respect to a length of the second ground-extension bracket 214B within the third plane, e.g., corresponding to a line formed by the edge of the second edge 11B of the PCB. The radio 220, upon applying a second signal to the second RF feed, causes the second radiating element 208B to radiate electromagnetic energy in a second radiation pattern. When the first radiation pattern is combined with the second radiation pattern, the first radiation pattern and the second radiation pattern collectively form a multi-polarization radiation pattern or a cross-polarization radiation pattern.

More specifically, the first radiation pattern is oriented at a first angle of polarization with respect to the first plane of the PCB 10 and set by a height of the first ground-extension bracket 214A. The second radiation pattern is oriented at a second angle of polarization with respect to the first plane of the PCB 10 and set by a height of the second ground-extension bracket 214B. In one embodiment, the first angle may be acute and angled towards the first ground-extension bracket 214A and the second angle may be acute and angled towards the second ground-extension bracket 214B, yielding multi-polarization of the combination of the first radiation pattern and the second radiation pattern. In other words, the second angle may be obtuse with respect to the first plane of the PCB when compared with the first angle due to the second ground-extension bracket 214B being located at a different end of the second radiating element 208B when compared with the mutual orientation of the first ground-extension bracket 214A and the first radiating element 208A. This multi-polarization of the combination of the first radiation pattern and the second radiation pattern may be also seen as a result of better antenna diversity that improves envelope correlation coefficient (ECC), despite the first antenna 202A and the second antenna 202B being co-located on the PCB.

When the first angle is an acute 45-degree angle with respect to the PCB, the second radiation pattern may be offset from the first angle by 90 degrees, causing the combination of the first radiation pattern and the second radiation pattern to cumulatively form a cross-polarization pattern that is neither vertical nor horizontal. Furthermore, locating the second antenna 202B on the second edge 11B of the PCB adjacent to, and turned 90 degrees with respect to, the first antenna 202A located on the first edge 11A of the PCB, provides for 360-degree coverage of the cross-polarization radiation pattern. Where the antenna diversity yields cross-polarization of the first radiation pattern and the second radiation pattern (each of the first angle and the second angle is set at opposing 45-degree angles), the ECC is achieved closest to zero for the disclosed MIMO architecture.

With further reference to FIGS. 2A, 2B, 2C, and 2D, a third antenna 202C that radiates at the second frequency may include a third ground element 204C, a third ground-extension element 214C, a third radiating element 208C, a third isolation region 210C, and another third isolation region 212C. A third RF feed 222C may be coupled between the radio 220 and the third radiating element 208C. The third antenna 202C may be disposed along the second edge 11B of the PCB 10, e.g., along an edge of the second edge 11B. In an alternative embodiment, the third antenna 202C is located along a fourth edge 11D of the antenna that is opposite to the second edge 11B (shown in dashed lines). The second ground-extension bracket 214B may be physically coupled to the PCB 10 and electrically coupled to the second ground element 204B. The third ground-extension bracket 214C extends from the PCB 10 in a fourth plane that is orthogonal to the first plane of the PCB and identical to the second plane (where in the alternative embodiment, the second plane and the fourth plane are not identical). The third radiating element 208 C is disposed on the PCB 10 and coupled to the third RF feed 222C. The third radiating element 208C is oriented linearly with respect to a length of the third ground-extension bracket 214C within the fourth plane, e.g., corresponding to a line formed by the edge of the second edge 11B of the PCB. The radio 220, upon applying a third signal to the third RF feed 222C, causes the third radiating element 208C to radiate electromagnetic energy in a third radiation pattern.

A fourth antenna 202D that radiates at the second frequency may include a fourth ground element 204D, a fourth ground-extension element 214D, a fourth radiating element 208D, a fourth isolation region 210D, and another fourth isolation region 212D. A fourth RF feed 222D may be coupled between the radio 220 and the fourth radiating element 208C. The fourth antenna 202D may be disposed along the third edge 11C of the PCB 10 (opposite to the first edge 11A), e.g., along an edge of the third edge 11C. The fourth ground-extension bracket 214D may be physically coupled to the PCB 10 and electrically coupled to the fourth ground element 204B. The fourth ground-extension bracket 214D extends from the PCB 10 in a fifth plane that is orthogonal to the first plane of the PCB and to the fourth plane of the third ground-extension bracket 114C. The fourth radiating element 208D is disposed on the PCB 10 and coupled to the fourth RF feed 222D. The fourth radiating element 208D is oriented linearly with respect to a length of the fourth ground-extension bracket within the fifth plane, e.g., corresponding to a line formed by the edge of the third edge 11C of the PCB. The radio 220, upon applying a fourth signal to the fourth RF feed that causes the fourth radiating element 208D to radiate electromagnetic energy in a fourth radiation pattern. When the third radiation pattern is combined with the fourth radiation pattern, the third radiation pattern and the fourth radiation pattern collectively form a multi-polarization radiation pattern or a cross-polarization radiation pattern.

More specifically, the third radiation pattern is oriented at a third angle of polarization with respect to the first plane of the PCB 10 and set by a height of the third ground-extension bracket 214C. The fourth radiation pattern is oriented at a fourth angle of polarization with respect to the first plane of the PCB 10 and set by a height of the fourth ground-extension bracket 214D. In one embodiment, the third angle may be acute and angled towards the third ground-extension bracket 214C and the fourth angle may be acute and angled towards the fourth ground-extension bracket 214D, yielding multi-polarization of the combination of the third radiation pattern and the fourth radiation pattern. In other words, the fourth angle may be obtuse with respect to the first plane of the PCB when compared with the third angle due to the fourth ground-extension bracket 214D being located at a different end of the fourth radiating element 208D when compared with the mutual orientation of the third ground-extension bracket 214C and the third radiating element 208C. This multi-polarization of the combination of the third radiation pattern and the fourth radiation pattern may be also seen as a result of better antenna diversity that improves envelope correlation coefficient (ECC) for the disclosed MIMO architecture.

When the third angle is an acute 45 degree angle with respect to the PCB, the fourth radiation pattern may be offset from the third angle by 90 degrees, causing the combination of the third radiation pattern and the fourth radiation pattern to cumulatively form a cross-polarization pattern that is neither vertical nor horizontal. Furthermore, locating the fourth antenna 202D on the third edge 11C of the PCB adjacent to, and turned 90 degrees with respect to, the third antenna 202C located on the second edge 11B of the PCB, provides for 360-degree coverage of the cross-polarization radiation pattern. Additionally, where the antenna diversity yields cross-polarization of the third radiation pattern and the fourth radiation pattern (each of the third angle and the fourth angle is set at opposing 45-degree angles), the ECC is achieved closest to zero for the disclosed MIMO architecture.

Figure 3A:
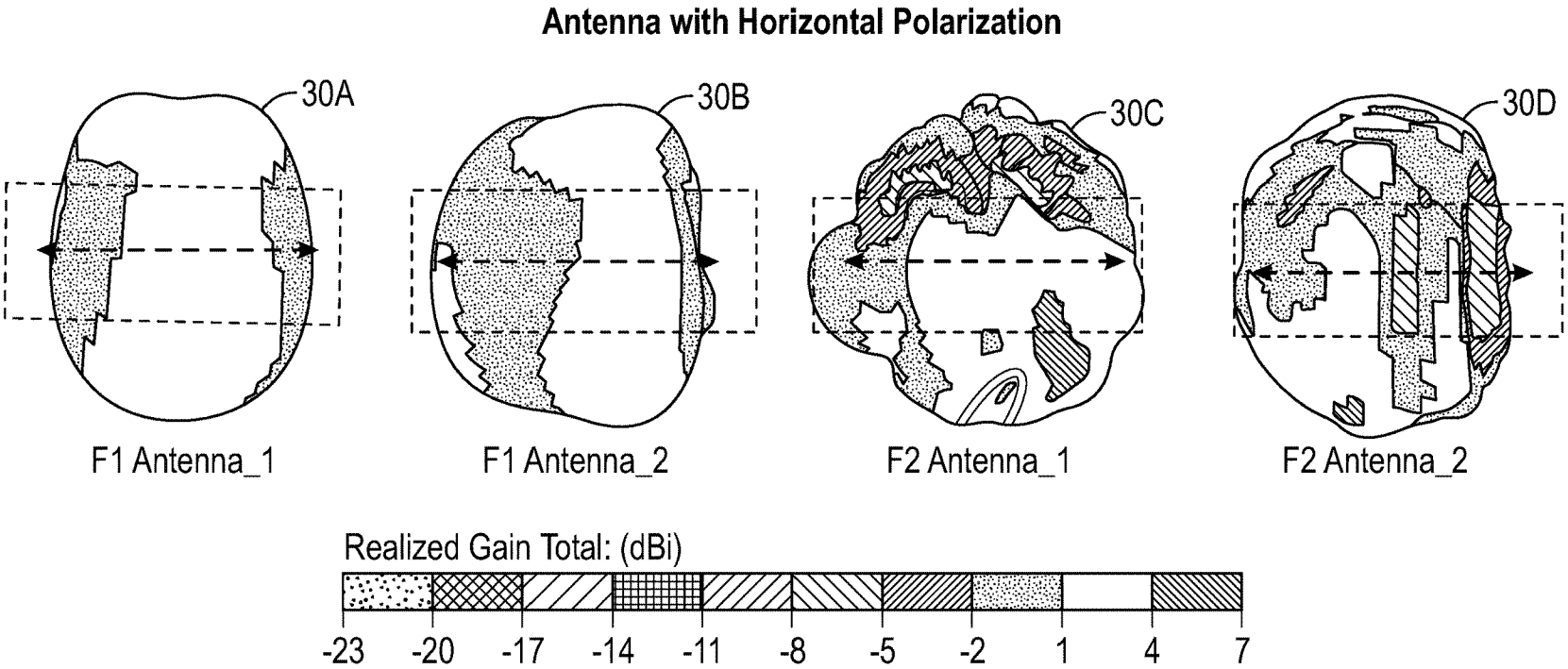
FIG. 3A illustrates a set of radiation patterns corresponding to horizontal polarization of electromagnetic energy for traditional MIMO architecture in which antennas share a single ground plane according to one embodiment.

FIG. 3A illustrates a set of radiation patterns corresponding to horizontal polarization of electromagnetic energy for traditional MIMO architecture in which antennas share a single ground plane according to one embodiment. From left to right in FIG. 3A, depicted are a first radiation pattern 30A, corresponding to a first horizontally-polarized dipole antenna radiating electromagnetic energy at a first frequency, and a second radiation pattern 30B, corresponding to a second horizontally-polarized dipole antenna radiating electromagnetic energy at the first frequency. Further from left to right, depicted are a third radiation pattern 30C, corresponding to a third horizontally-polarized dipole antenna radiating electromagnetic energy at a second frequency, and a fourth radiation pattern 30D, corresponding to a fourth horizontally-polarized dipole antenna radiating electromagnetic energy at the second frequency. Note the various shadings over each radiation pattern are indications of realized gain (dBm) according to the legend at the bottom of FIGS. 3C and 3D.

Figure 3B:
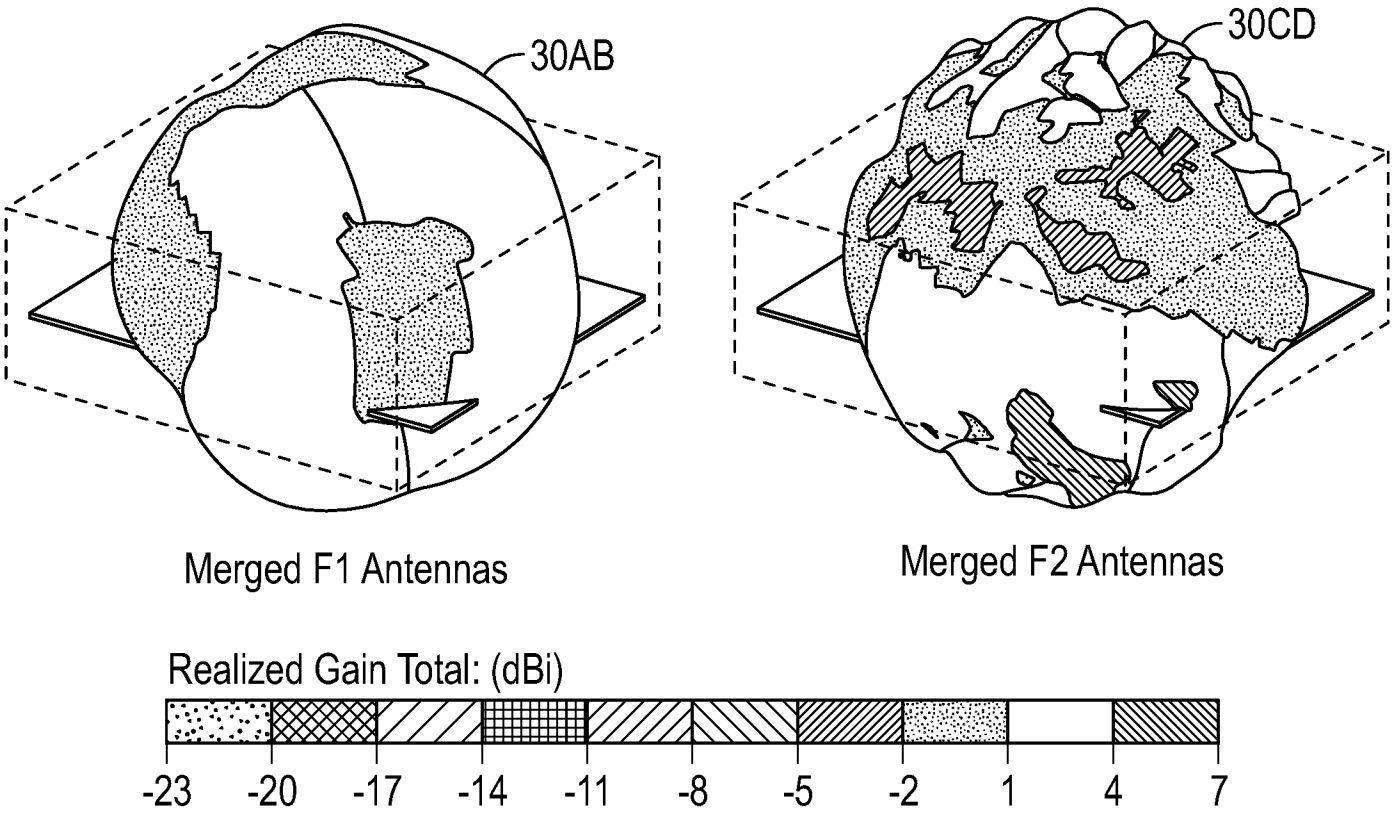
FIG. 3B illustrates a set of merged radiation patterns from the combination of the radiation patterns for each frequency illustrated in FIG. 3A according to one embodiment.

FIG. 3B illustrates a set of merged radiation patterns from the combination of the radiation patterns for each frequency illustrated in FIG. 3A according to one embodiment. For example, a first merged radiation pattern 30AB is a combination of the first radiation pattern 30A and the second radiation pattern 30B, and a second merged radiation pattern 30CD is a combination of the third radiation pattern 30C and the fourth radiation pattern 30D.

Figure 3C:
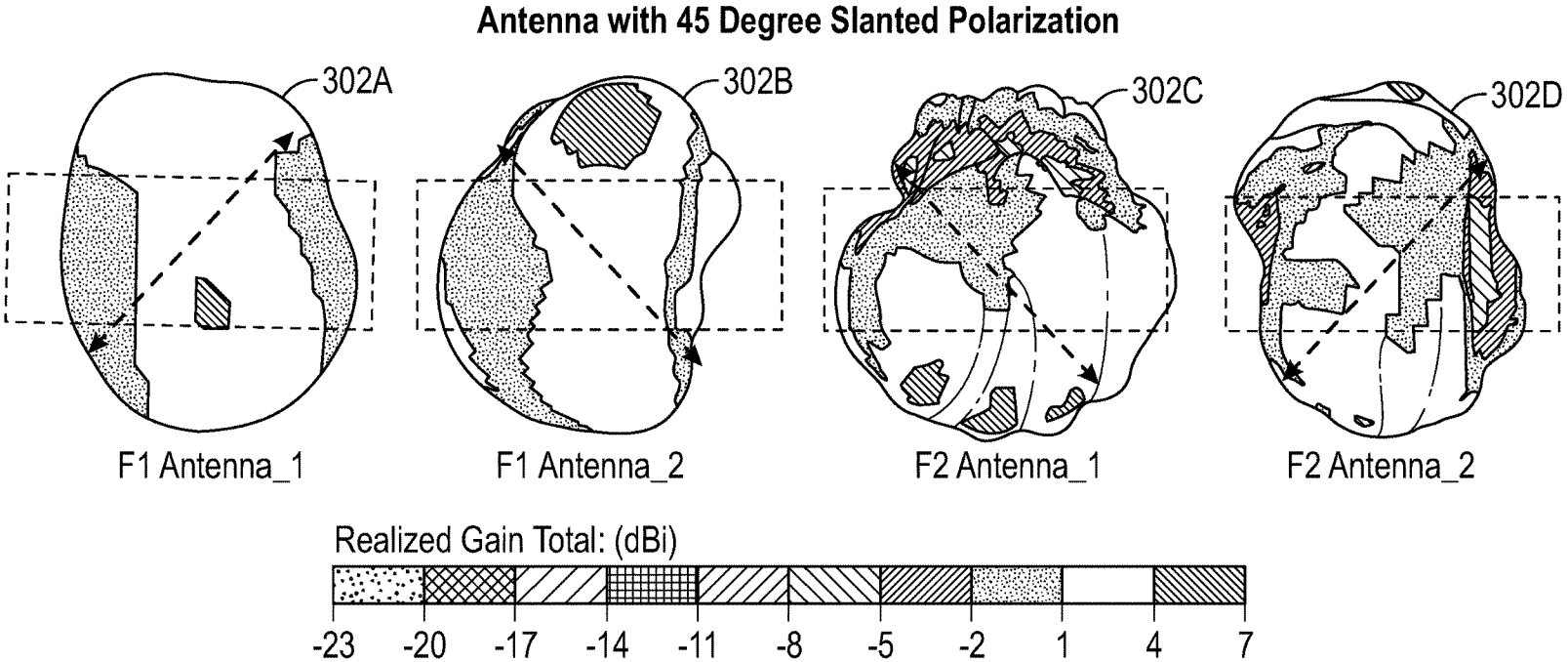
FIG. 3C illustrates a set of radiation patterns corresponding to angled polarization of electromagnetic energy for the disclosed MIMO architecture having separated ground elements according to one embodiment.

FIG. 3C illustrates a set of radiation patterns corresponding to angled polarization of electromagnetic energy for the disclosed MIMO architecture having separated ground elements according to one embodiment. From left to right in FIG. 3C, depicted are a first radiation pattern 302A corresponding to the first antenna 202A radiating electromagnetic energy at a first frequency and a first angle of polarization, a second radiation pattern 302B corresponding to the second antenna 202B radiating electromagnetic energy at the first frequency and a second angle of polarization, a third radiation pattern 302C corresponding to the third antenna 202C radiating electromagnetic energy at a second frequency and third angle of polarization, and a fourth radiation pattern 302B corresponding to a the fourth antenna 202D radiating electromagnetic energy at the second frequency and a fourth angle of polarization. As described above, all four of these angles are acute when viewed as being angled towards a ground-extension bracket of each respective antenna.

In various embodiments, however, the first angle is acute, the second an angle is obtuse, the third angle is obtuse, and the fourth angle is acute, where the angles of polarization are viewed with respect to a set of Cartesian coordinates from the perspective of each antenna with respect to the plane of the PCB 10. In some embodiments, the first angle may be 45 degrees with respect to the PCB 10 and the second angle may be negative 45 degrees with respect to the PCB 10. Furthermore, the third angle may be a negative 45 degrees and the fourth angle may be positive 45 degrees. Alternatively, or additionally, the second angle may be said to be 45 degrees (similar to the first angle of polarization), but oriented at a 90-degree offset with respect to the first angle of polarization due to a change in perspective of from where the second angle of polarization originates. Similarly, the fourth angle may be said to be oriented at a 90-degree offset with respect to the third angle.

Figure 3D:
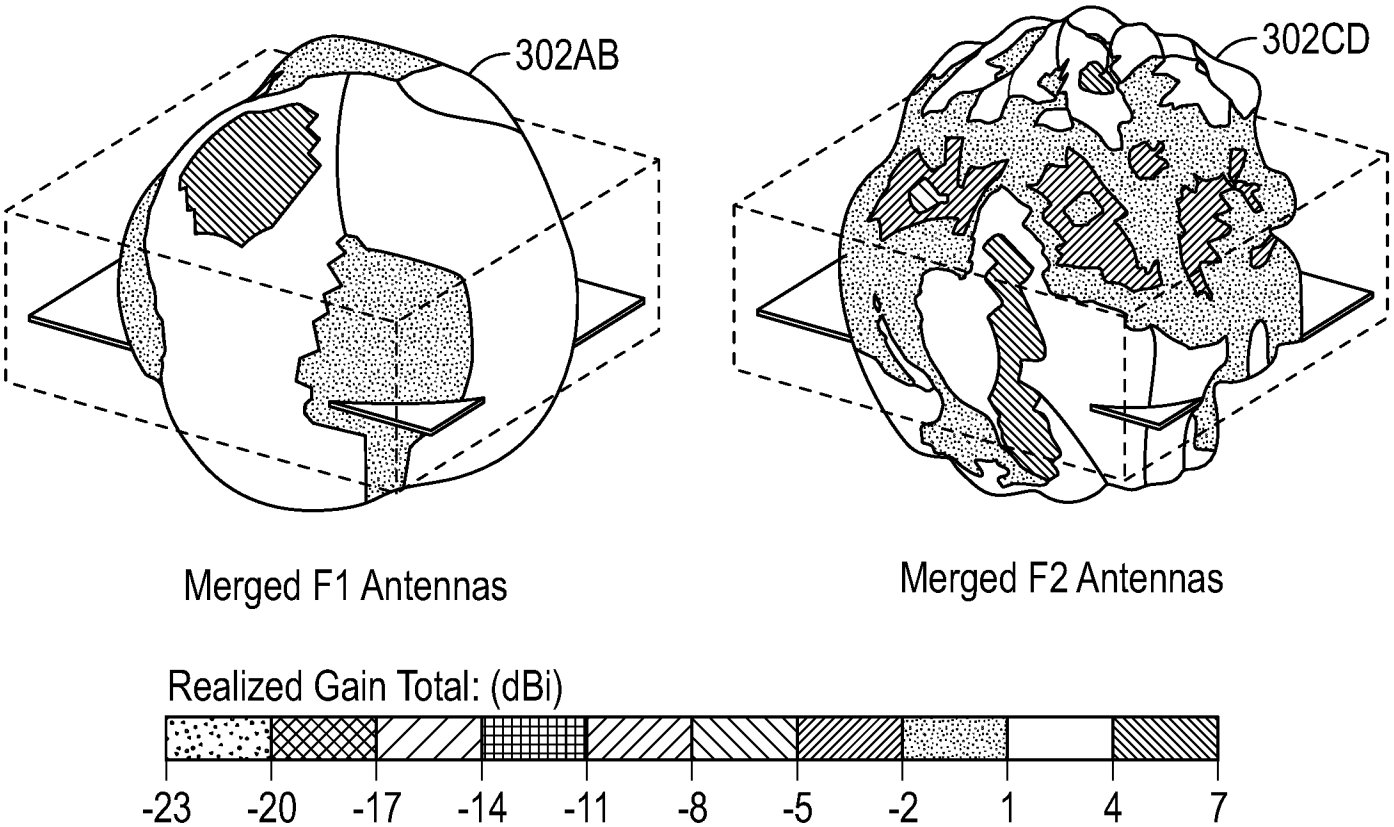
FIG. 3D illustrates a set of merged radiation patterns from the combination of the radiation patterns for each frequency illustrated in FIG. 3C according to one embodiment.

FIG. 3D illustrates a set of merged radiation patterns from the combination of the radiation patterns for each frequency illustrated in FIG. 3C according to one embodiment. For example, a first merged radiation pattern 302AB is a combination of the first radiation pattern 302A and the second radiation pattern 302B, and a second merged radiation pattern 302CD is a combination of the third radiation pattern 302C and the fourth radiation pattern 302D.

Figure 4A:
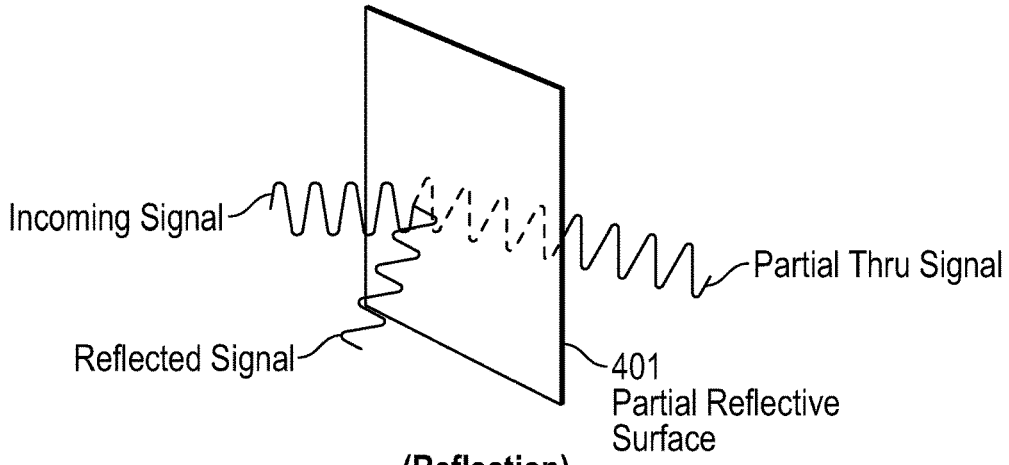
FIG. 4A illustrates reflection of a radio frequency (RF) wave according to one embodiment.

FIG. 4A illustrates reflection of a radio frequency (RF) wave according to one embodiment. The RF wave illustrated in FIG. 4A may be at least partially reflected off of a partially reflective surface 401 (such as a wall, window, or other obstacle containing RF-reflective material). Note that the RF wave only partially makes it through the surface 401, and the other part of the RF wave becomes the reflective signal, going in a different direction at a different polarization than the (now) partial RF wave that made it through the surface 401. The change of polarization is due to some component of the partially reflective surface 401 having an orientation that is not parallel with the polarization of the RF incident wave.

Figure 4B:
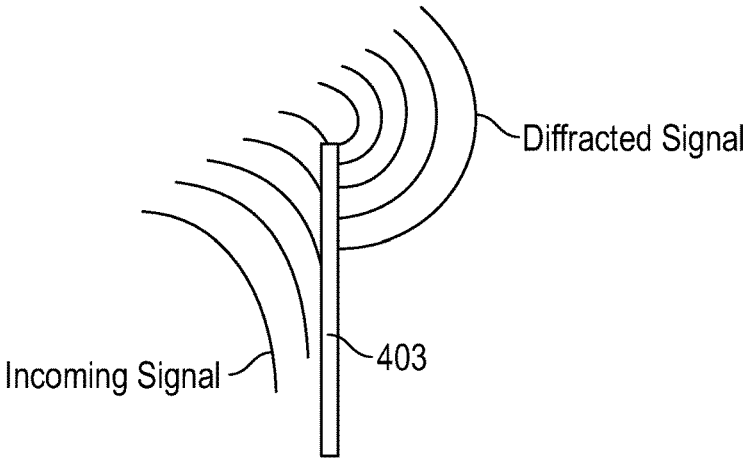
FIG. 4B illustrates diffraction of a RF wave according to one embodiment.

FIG. 4B illustrates diffraction of a RF wave according to one embodiment. The RF wave has now diffracted around a rectangular object 403, which can be any object made of metal, dielectric, or some mixture thereof that may cause the RF wave to bend around the rectangular object 403. The RF wave has thus again at least partially changed polarization within a space of whatever room or environment through which the RF wave is passing. This is because the rectangular object 403 has some component of orientation that is not parallel with the polarization of the incident wave.

Figure 4C:
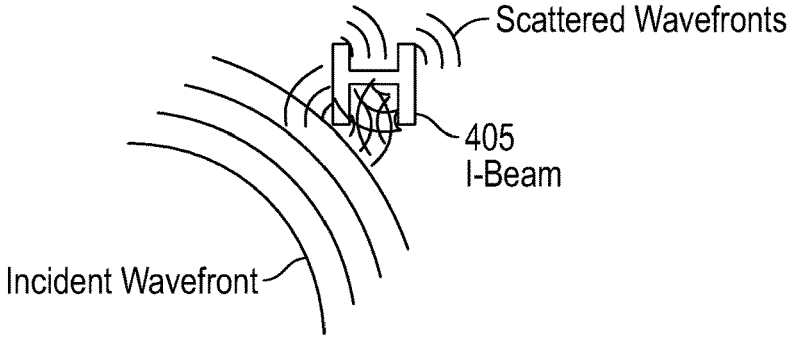
FIG. 4C illustrates scattering of a RF wave according to one embodiment.

FIG. 4C illustrates scattering of a RF wave according to one embodiment. The RF wave has now scattered off of an I-beam 405 of the like typically found in homes and office buildings. The scattering causes multiple new RF waves propagating with a different polarization than the incident RF wave, because there are multiple components of the I-beam 405 of an orientation that is not parallel with the polarization of the incident RF wave.

The reflected, diffracted, and scattered RF waves of FIGS. 4A, 4B, and 4C now have different polarizations than the original RF wave that may have radiated from a wireless antenna with a certain linear polarization, meaning that the polarizations may no longer be truly linear. This adds an unexpected polarization mismatch loss as depicted in Table 1 (where the degree of mismatch loss depends on orientation angle with respect to the incident wave).

TABLE 1

| Orientation Angle | Polarization Mismatch (dB) |
|---|---|
| 0.0 (aligned) | 0.0 |
| 15.0 | 0.3 |
| 30.0 | 1.25 |
| 45.0 | 3.01 |
| 60.0 | 6.02 |
| 75.0 | 11.74 |
| 90.0 | ∞ |

Figure 5:
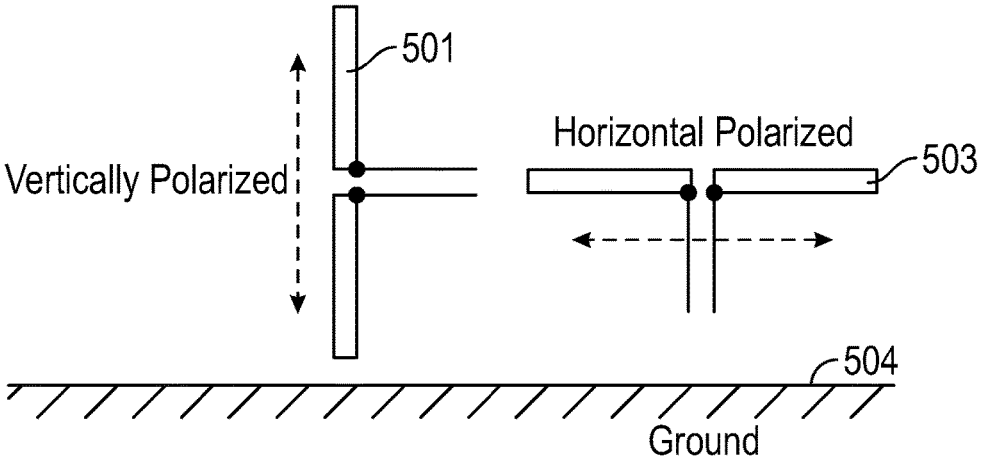
FIG. 5 illustrates two kinds of linear polarization of electromagnetic energy, including vertical polarization and horizontal polarization.

FIG. 5 illustrates two kinds of linear polarization of electromagnetic energy, including vertical polarization and horizontal polarization. More particularly, a first dipole antenna 501 is linearly polarized and a second dipole antenna 503 is horizontally polarized. These are the two main kinds of linear polarization previously available in small form factor user electronic devices due to confined spaces and due to the fact that the antennas on a single PCB 10 share a common ground plane 504.

Figure 6:
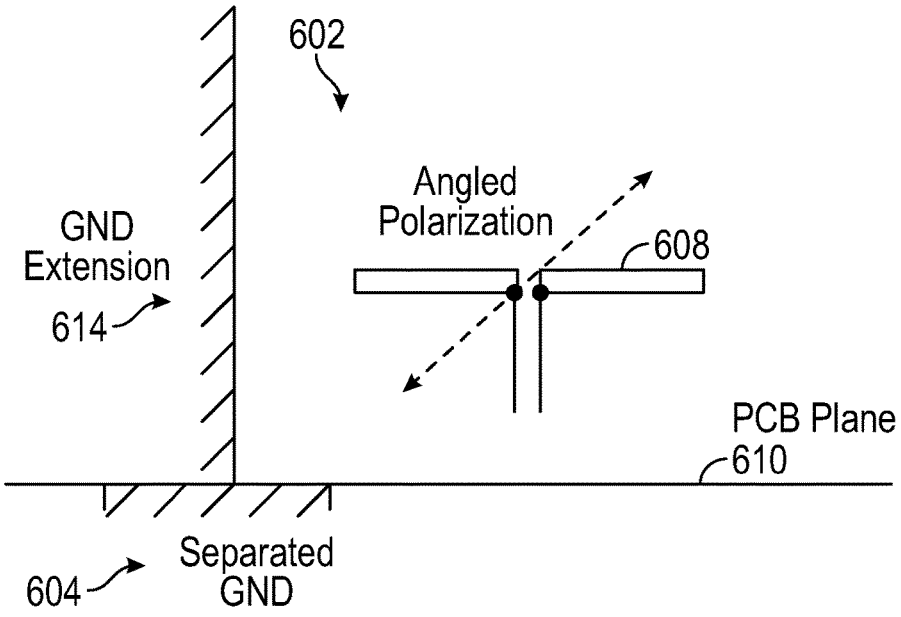
FIG. 6 illustrates angled polarization of electromagnetic energy according to various disclosed embodiments.

FIG. 6 illustrates angled polarization of electromagnetic energy according to various disclosed embodiments. Here, an antenna 602 according to the disclosed embodiments includes a radiating element 608 that, while being horizontally oriented, nonetheless radiates electromagnetic energy with angled polarization with respect to a PCB plane 610. This is because the antenna 601 is configured with a separated ground 604 together with a ground extension 614 (e.g., due to the above-discussed ground element 104 and coupled ground-extension bracket 114). In the embodiment of FIG. 6, the orientation of the angle of polarization with respect to the PCT plane 610 is acute and is angled towards the ground extension 614, e.g., due to the ground-extension bracket 114 pulling the radiation pattern of the antenna 602 towards itself.

Figure 7:
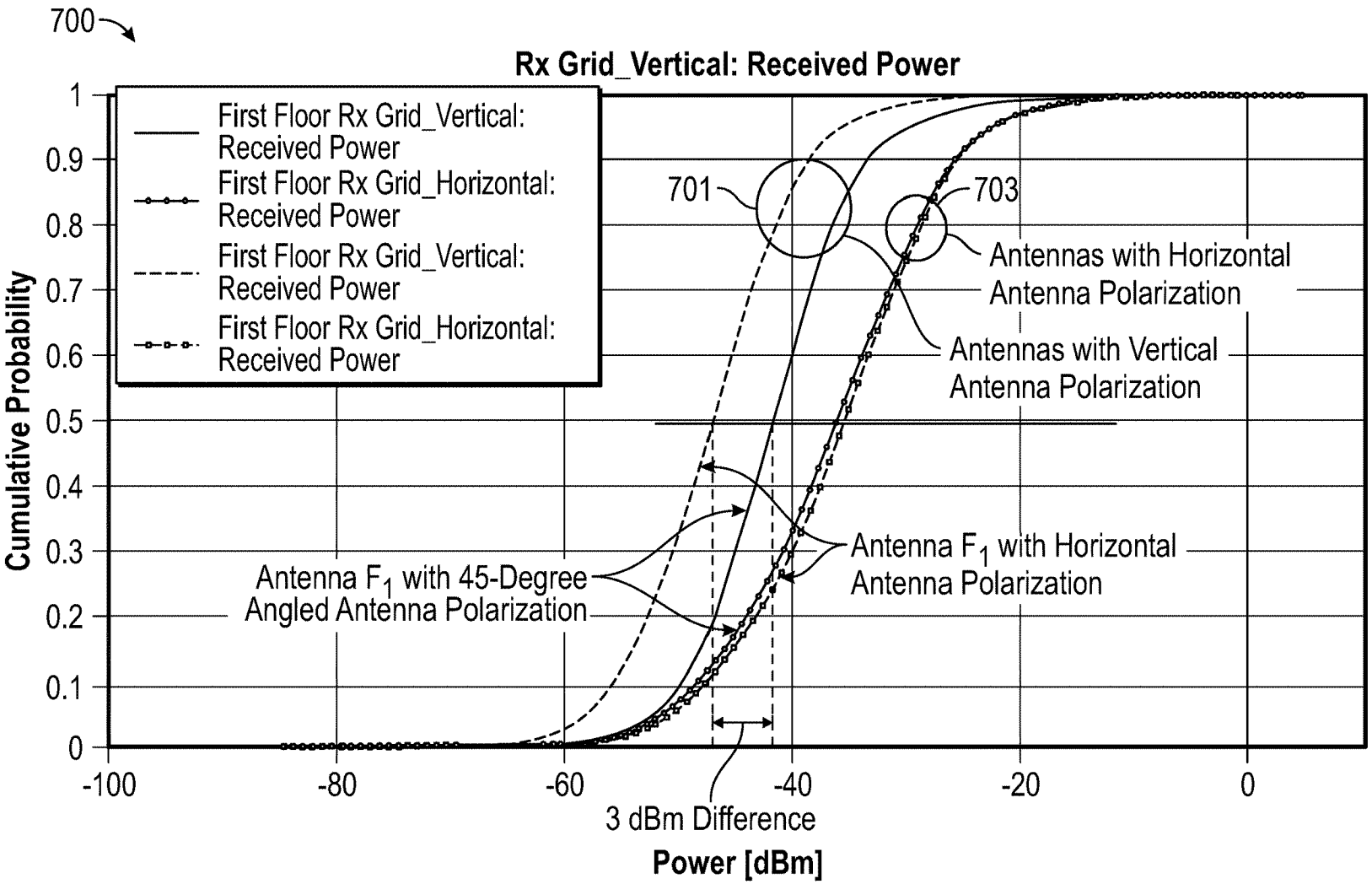
FIG. 7 is a graph illustrating a cumulative distribution function (CDF) for a disclosed 2.4 GHz antenna with 45-degree polarization compared to 2.4 GHz antennas with horizontal polarization.

FIG. 7 is a graph 700 illustrating a cumulative distribution function (CDF) for a disclosed 2.4 GHz antenna with 45-degree polarization compared to 2.4 GHz antennas with horizontal polarization. This experiment was performed by placing an electronic device with these antennas on the first floor of a wood house. Note that the left-two curves of the graph 700 indicate electromagnetic power as received from by vertically-polarized receiving antennas (indicated with circle 701) and the right-two curves indicate electromagnetic power as received from horizontally-polarized receiving antennas (indicated with circle 703). As illustrated, the received power by the vertically-polarized receiving antennas of the 45-degree polarized radiation pattern is 3 dBm higher than that of the horizontally-polarized radiation pattern, indicating the ability of the 45-degree polarized radiation pattern to better travel through obstacles of the house. Furthermore, the difference in the received power by the horizontally-polarized antennas is less, which is likely due to the fact that the comparison is being made to a horizontally-polarized transmitting antenna.

Figure 8:
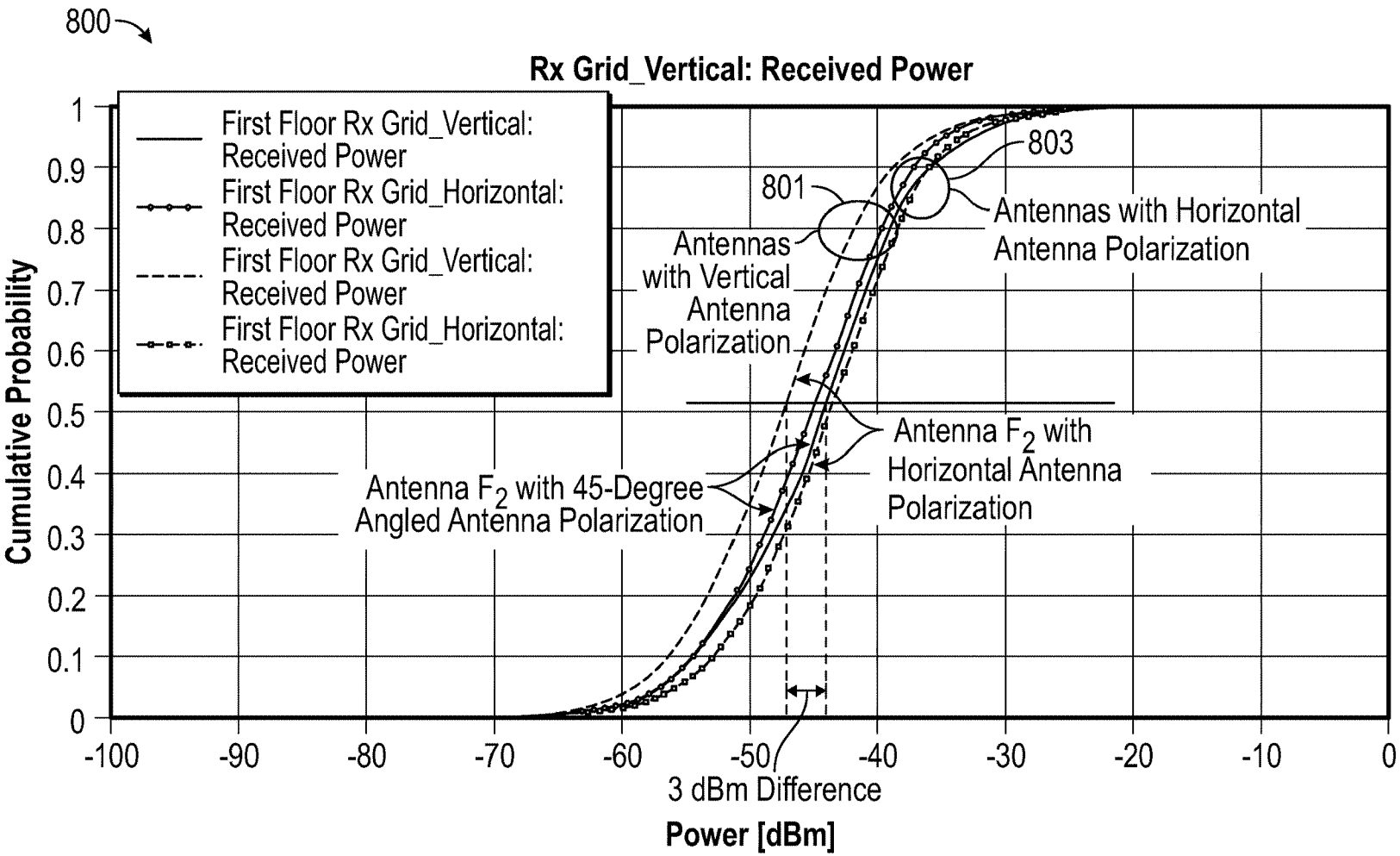
FIG. 8 is a graph illustrating a cumulative distribution function (CDF) for a disclosed 5 GHz antenna with 45-degree polarization compared to 5 GHz antennas with horizontal polarization.

FIG. 8 is a graph 800 illustrating a cumulative distribution function (CDF) for a disclosed 5 GHz antenna with 45-degree polarization compared to 5 GHz antennas with horizontal polarization. This experiment was performed by placing an electronic device with these antennas on the first floor of a wood house. Note that the left-two curves of the graph 700 indicate electromagnetic power as received from by vertically-polarized receiving antennas (indicated with circle 801) and the right-two curves indicate electromagnetic power as received from horizontally-polarized receiving antennas (indicated with circle 803). A similar improvement is received electromagnetic power is noted by the vertically-polarized receiving antennas.

Figure 9:
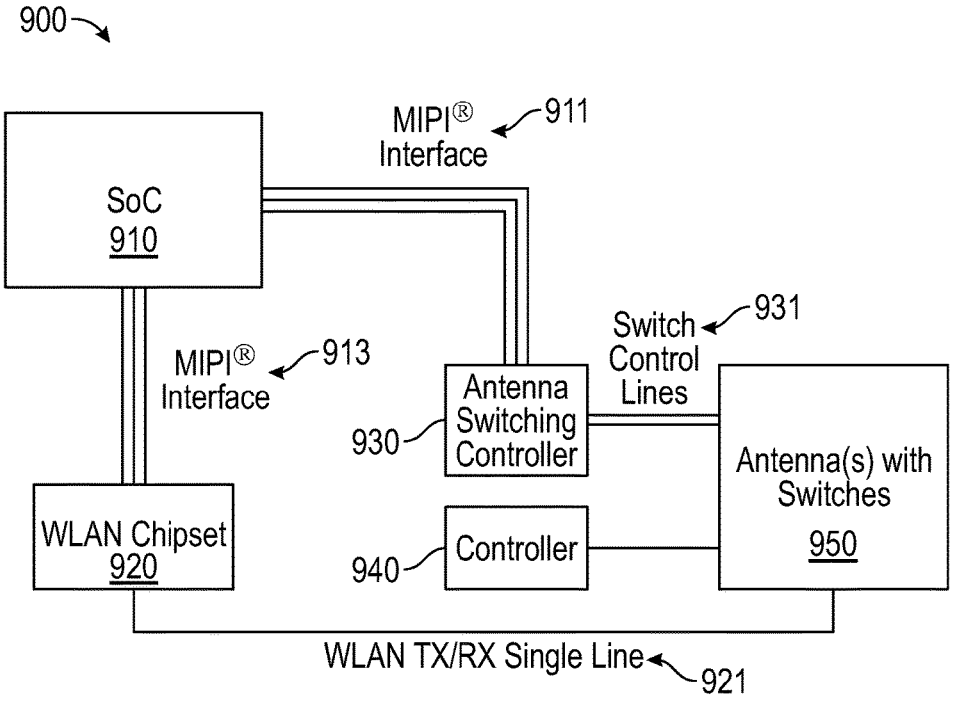
FIG. 9 is a circuit diagram illustrating an electronic device with antenna control architecture to control angle of polarization at which the antennas radiate electromagnetic energy, according to various embodiments.

FIG. 9 a circuit diagram illustrating an electronic device 900 with antenna control architecture to control angle of polarization at which the antennas radiate electromagnetic energy, according to various embodiments. The electronic device 900 may include, but not be limited to, a system on a chip (SoC) 910 (or other main processor of the electronic device), a WLAN chipset 920, an antenna switching controller 930, another controller 940, and a set of antenna(s) with switches 950. The electronic device 900 may further include a first Mobile Industry Processor Interface (MIPI®) 911 between the SoC 910 and the antenna switching controller 930 and a second MIPI® interface 913 between the SoC 910 and the WLAN chipset 920. The WLAN chipset 920 may be coupled to the antennas with switches 912 through a WLAN transmission/receiving line 921, and may send signals to RF feed lines coupled to radiating elements of the antennas.

The antenna switching controller 930 may send control signals over one or more switch control lines 931 to cause switches of the antennas to turn on or off, thus changing the polarization of the antennas as will be discussed in more detail with reference to FIGS. 10A-10D and 11A-11C. The separate controller 940 may perform additional control of the antennas, such as whether to activate the switches on the antennas at all. In one embodiment, the separate controller 940 is combined into the antenna switching controller 930, as a single antenna controller. The SoC 910 (or the WLAN chipset 920) may affect the nature of these control signals (sent by the antenna switching controller 930 and the controller 940) based on receipt of a received signal strength indicator (RSSI) from the antenna(s) with switches 950. In an alternative embodiment, the antenna switching controller 930 and/or the controller 940 may be combined in the SoC 910, the WLAN chipset 920, or into a combination of both to perform the control necessary to achieve favorable multi-polarization radiation patterns and low ECC.

Figure 10A:
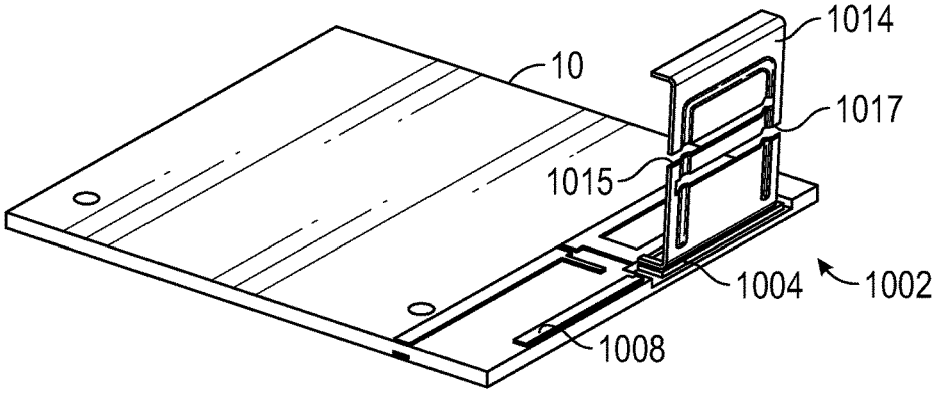
FIG. 10A illustrates an antenna with a ground-extension bracket according to an embodiment.

FIG. 10A illustrates an antenna 1002 with a ground-extension bracket 1014 according to an embodiment, which may be employed as any of the disclosed antennas of the present disclosure that are disposed on the PCB 10. The antenna 1002 also includes a ground element 104 to which the ground-extension bracket 1014 is electrically coupled, and a radiating element 1008 oriented linearly with respect to a length of the ground-extension bracket 1014, and along an edge of the PCB 10. Note that the ground-extension bracket 1014 may include a first horizontal slot 1015 and a second horizontal slot 1017. In one embodiment, the first horizontal slot 1015 extends up to or beyond a middle of the ground-extension bracket 1014 from a first edge, and the second horizontal slot 1017 extends up to or beyond the middle of the ground-extension bracket 1014 from a second edge of the ground-extension bracket, so that the first horizontal slot 1015 and the second horizontal slot 1017 interweave from one edge to the other edge of the ground-extension bracket 1014. Each of the first horizontal slot 1015 and the second horizontal slot 1017 may vary from being parallel with the PCB 10 and still be considered to be "horizontal" for purposes of this disclosure.

Figure 10B:
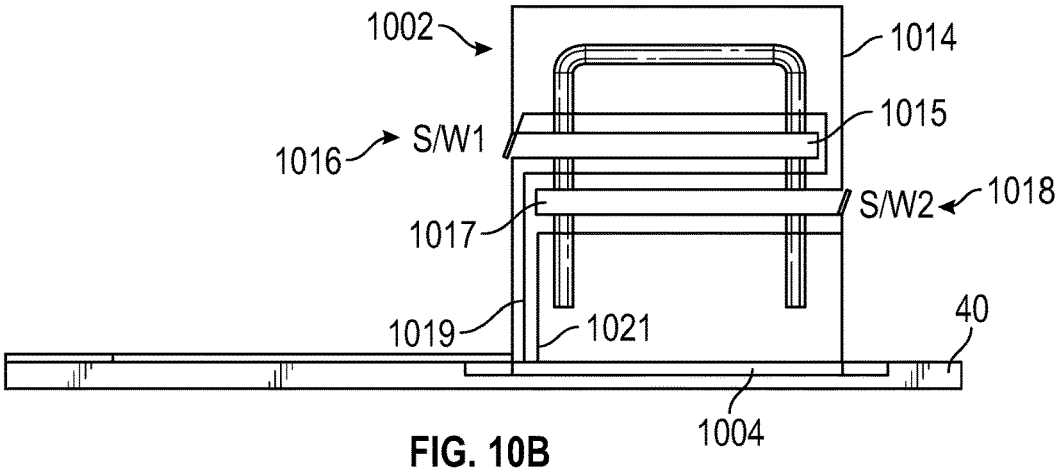
FIG. 10B is a plane view of the ground-extension bracket with horizontal slots and disposed switches, which allows a change of angle of polarization of the antenna, according to an embodiment.

FIG. 10B is a plane view of the ground-extension bracket 1014 of FIG. 10A, including the first horizontal slot 1015 and the second horizontal slot 1017. FIG. 10B additional illustrates a first switch 1016 coupled across the first horizontal slot 1015 (e.g., along an outer edge of the ground-extension bracket 1014) and a second switch 1018 coupled across the second horizontal slot 1017 (e.g., along an outer edge of the ground-extension bracket 1015). Each switch may close off the gap formed by a horizontal slot, and thus provide additional current flow across the slot.

In one embodiment, the ground-extension bracket 1014 is made of metal and each switch may be soldered on or otherwise attached. In another embodiment, the ground-extension bracket 1014 is made of either a rigid or flexible PCB material (e.g., that includes a planar metallic ground) into which are formed the first horizontal slot 1015 and the second horizontal slot 1017. Use of the PCB material for the ground-extension bracket 1014 may facilitate use of a pin diode or other semiconductor-based switch for each of the first switch 1016 and the second switch 1018.

The ground-extension bracket 1014 may further include a first control line 1019 coupled to the first switch 1016 and electronically coupled to a processing device, e.g., the antenna switching controller 930 or separate controller 940 (FIG. 9). The processing device may be configured to send a first control signal through the first control line to set a state of the first switch. The ground-extension bracket 1014 may further include a second control line 1021 coupled to the second switch 1018 and electronically coupled to the processing device. The processing device may be configured to send a second control signal through the second control line to set a state of the second switch.

Figure 10C:
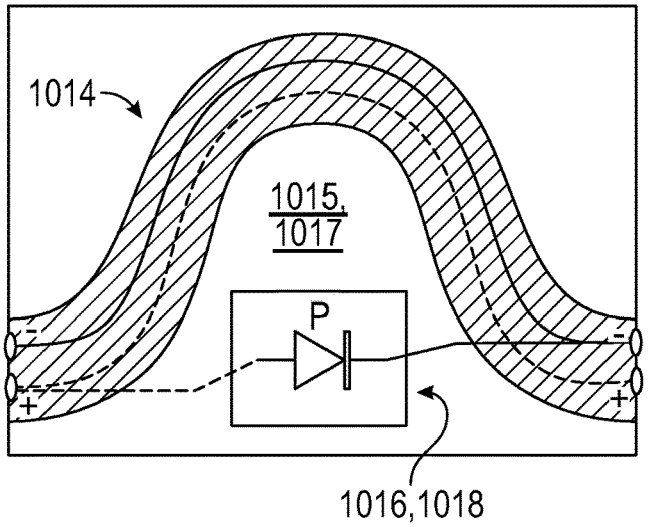
FIG. 10C is an electrical diagram of the switches illustrated in FIG. 10B, implemented as pin diodes, according to an embodiment.

FIG. 10C is an electrical diagram of the switches 1016 and 1018 illustrated in FIG. 10B according to an embodiment. In this embodiment, the switches 1016 and 1018 are implemented as a pin-diode, e.g., a diode with a wide, undoped intrinsic semiconductor region between a p-type semiconductor and an n-type semiconductor region. The p-type and n-type regions are typically heavily doped because they are used for ohmic contacts. Switch control line 1019 or 1021 may be connected to the positive line of the pin diode and the ground-extension bracket 1014 may be connected to the negative line of the pin diode. The switch 1016 or 1018 is made to open or close based on a level of voltage applied across the pin diode. In an alternative embodiment, the switches 1016 and 1018 may be a physical switch made of a magnetized material caused to open or close with the application (or removal) of voltage to one side of the switch. Other switches are envisioned.

As discussed with reference to FIG. 9, the antenna switching controller 930 (or the separate controller 940) may send control signals to the switches 1016 and 1018 based on receipt of a received signal strength indicator (RSSI) from the antenna 1002, to effect a change in state of one or both of the switches 1016 and 1018. In various embodiments, when a state one of the switches 1016 and 1018 is changed (e.g., was closed and now is opened or was opened and now is closed), the current flow through the ground-extension bracket 1014 changes such that the effective pattern of the ground extension 614 (FIG. 6) may change, thus adjusting the angle of polarization of the antenna 1002. Because there are two states, a first state for the first switch 1016 and a second state for the second switch 1018, a combination of the first state and the second state may be referred to as a global state, which ultimately determines at which angle of polarization the antenna 1002 radiates electromagnetic energy. Table 2 summarizes these states as follows.

TABLE 2

| | Switch States | |
|---|---|---|
| Global State | S/W1 | S/W2 |
| State #1 | OFF | OFF |
| State #2 | ON | OFF |
| State #3 | OFF | ON |
| State #4 | ON | ON |

Figure 10D:
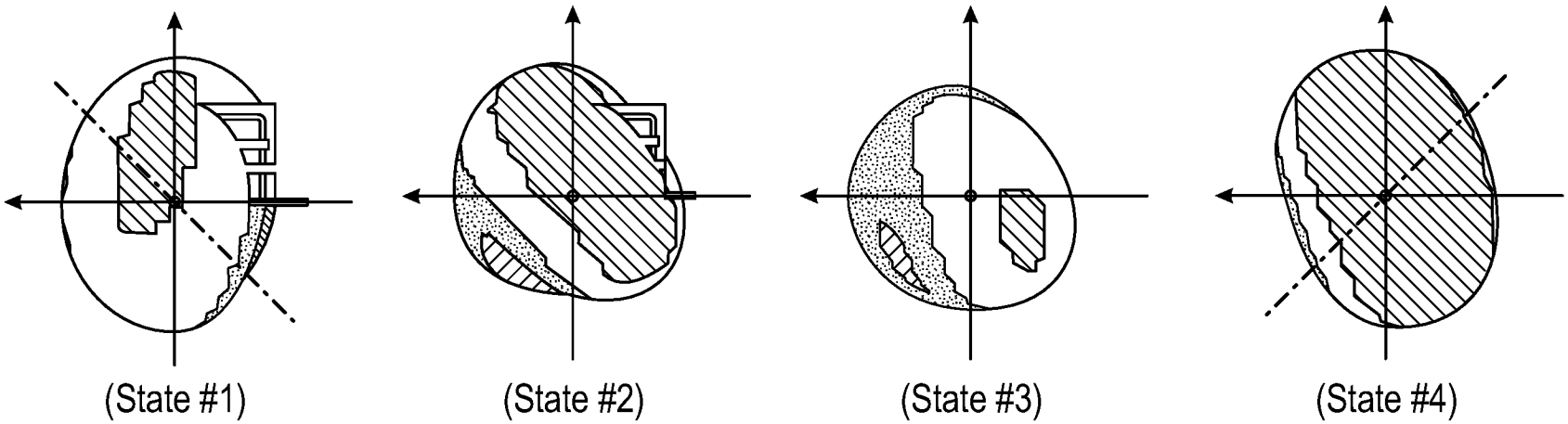
FIG. 10D illustrates a set of radiation patterns with different angled polarizations for different states of the switches illustrated in FIG. 10B according to an embodiment.

FIG. 10D illustrates a set of radiation patterns with different angled polarizations for different states of the switches illustrated in FIG. 10B according to an embodiment, including the global states illustrated in Table 2. The State #1 diagram illustrates a polarization of approximately a negative 30 degrees. The State #2 diagram illustrates a polarization of approximately a positive 45 degrees. The State #3 diagram illustrates a polarization of approximately a positive 15 degrees. The State #4 diagram illustrates a polarization of approximately a negative 30 degrees. These angles of polarization should be understood to be exemplary as others are available based on the shape and size of the ground-extension bracket 1014 and the shape and size of the horizontal slots 1015 and 1017.

According to various embodiments, and with further reference to FIGS. 10C and 10D, the antenna 1002 is configured to radiate in a radiation pattern at a first angle of polarization with respect to the plane of the PCB 10 when the first switch 1016 is in a first state and the second switch 1018 is in a first state (such as both ON or both OFF). The antenna 1002 is further configured to radiate electromagnetic energy in the radiation pattern at a second angle of polarization with respect to the plane when at least one of the first state of the first switch 1016 or the first state of the second switch 1018 is changed. Here, the second angle of polarization is one of three possible angles derived from the first switch 1016 being in a second state, the second switch 1018 being in the second state, or both.

Figure 11A:
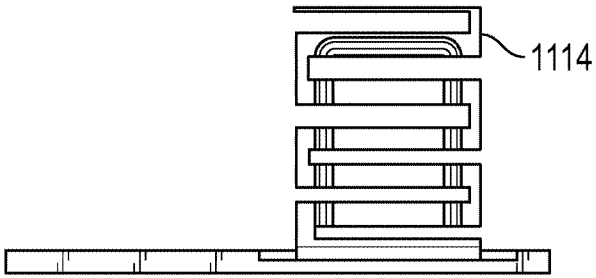
FIG. 11A is a side view of a ground-extension bracket with multiple horizontal slots according an embodiment.
Figure 11B:
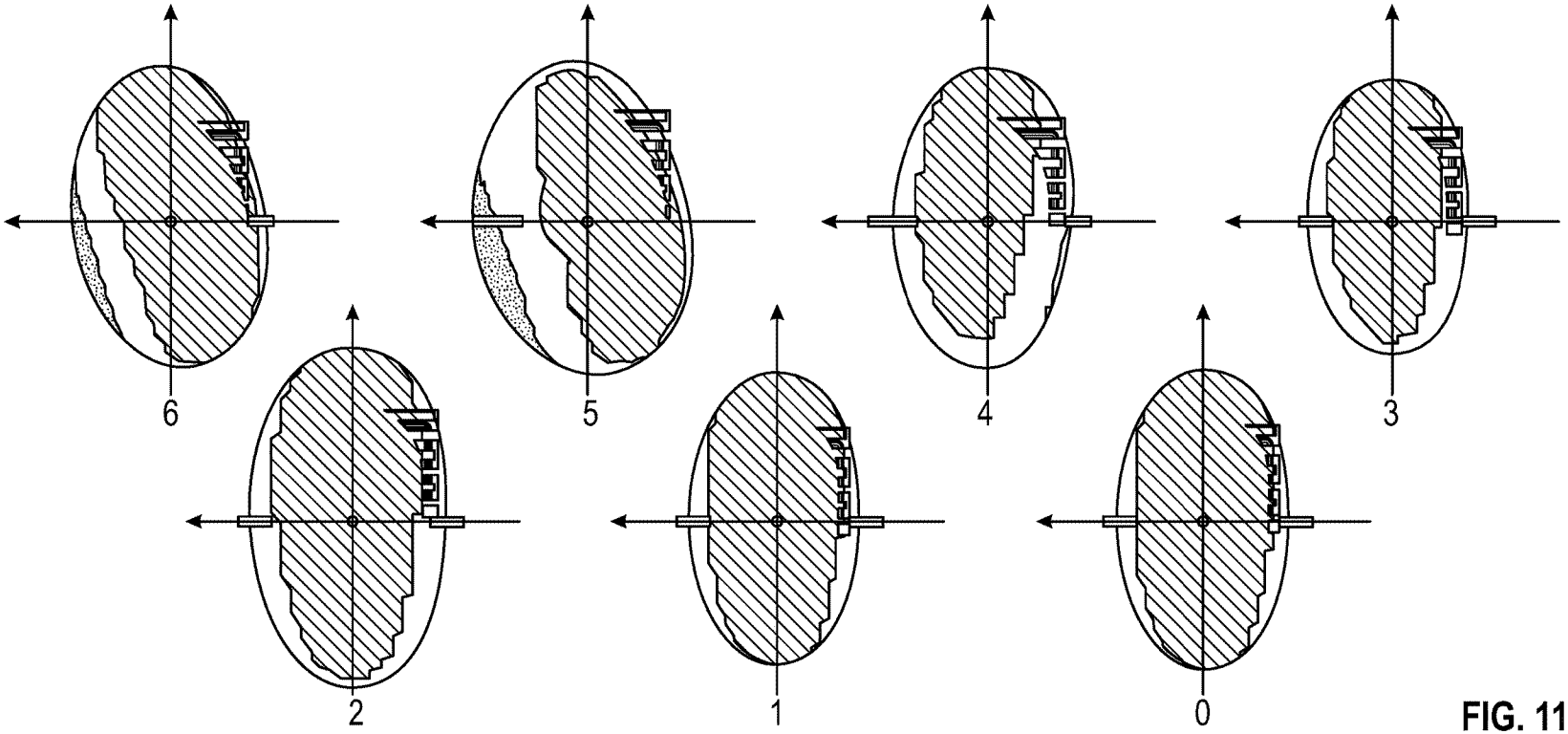
FIG. 11B illustrates a set of radiation patterns with different angled polarizations corresponding to various states of the horizontal slots of the ground-extension bracket illustrated in FIG. 11A according to an embodiment.
Figure 11C:
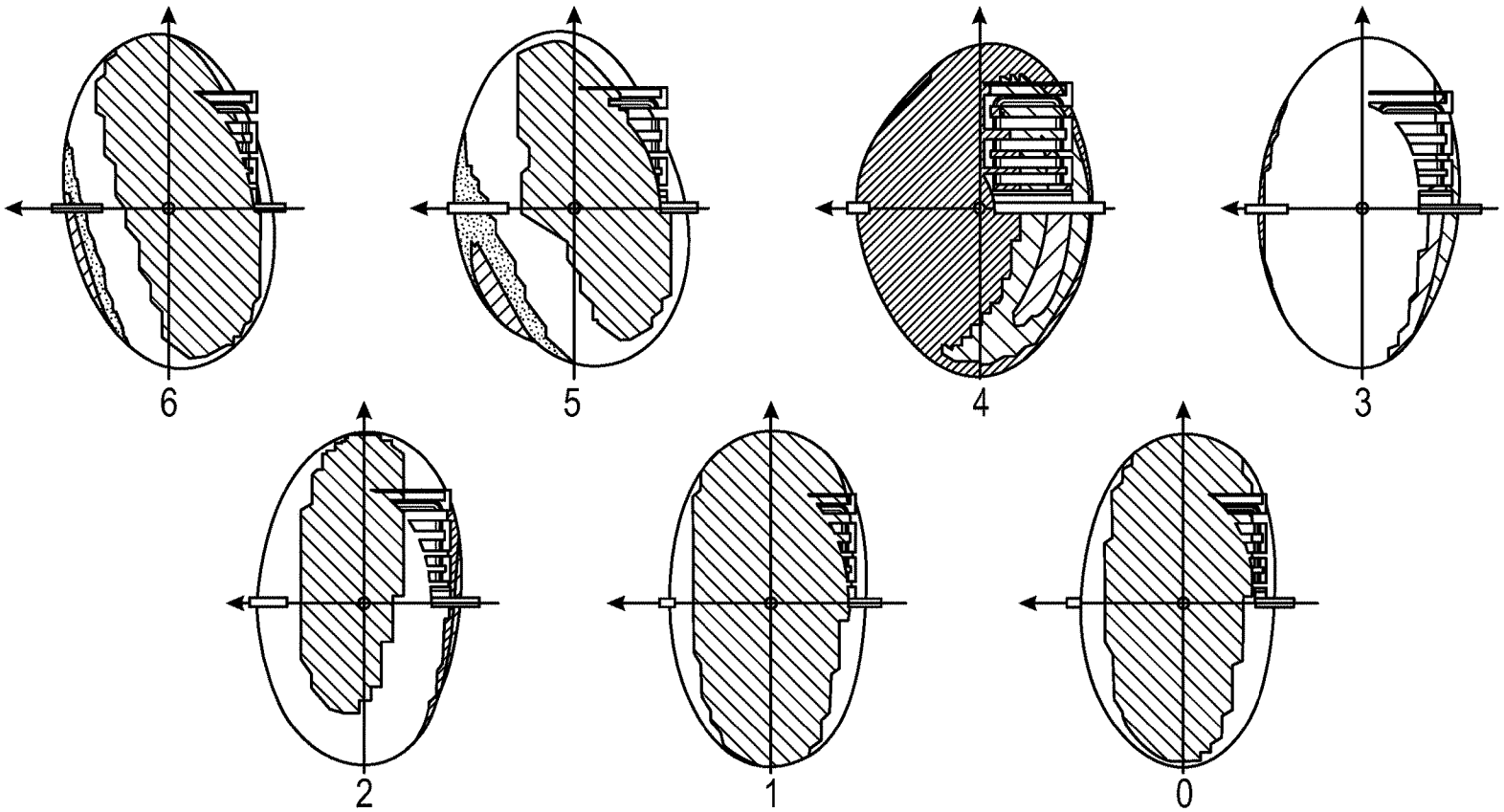
FIG. 11C illustrates a set of radiation patterns with different angled polarizations corresponding to various other states of the horizontal slots of the ground-extension bracket illustrated in FIG. 11A according to an embodiment.

FIG. 11A is a plane view of a ground-extension bracket 1114 with multiple horizontal slots according an embodiment. The illustrated ground-extension bracket 1114 now includes six horizontal slots, thus increasing the number of global states to many more global states, where a switch is coupled across each of these six horizontal slots. Note that in other embodiments, more or fewer horizontal slots may be used and those horizontal slots may vary in terms of size and shape, thus producing a large number of possible configurations. FIG. 11B illustrates a set of radiation patterns of different angled polarizations corresponding to some of the global states of the horizontal slots of the ground-extension bracket 1114 illustrated in FIG. 11A according to an embodiment. FIG. 11C illustrates a set of radiation patterns of different angled polarizations corresponding to various other states of the horizontal slots of the ground-extension bracket illustrated in FIG. 11A according to an embodiment.

Figure 12:
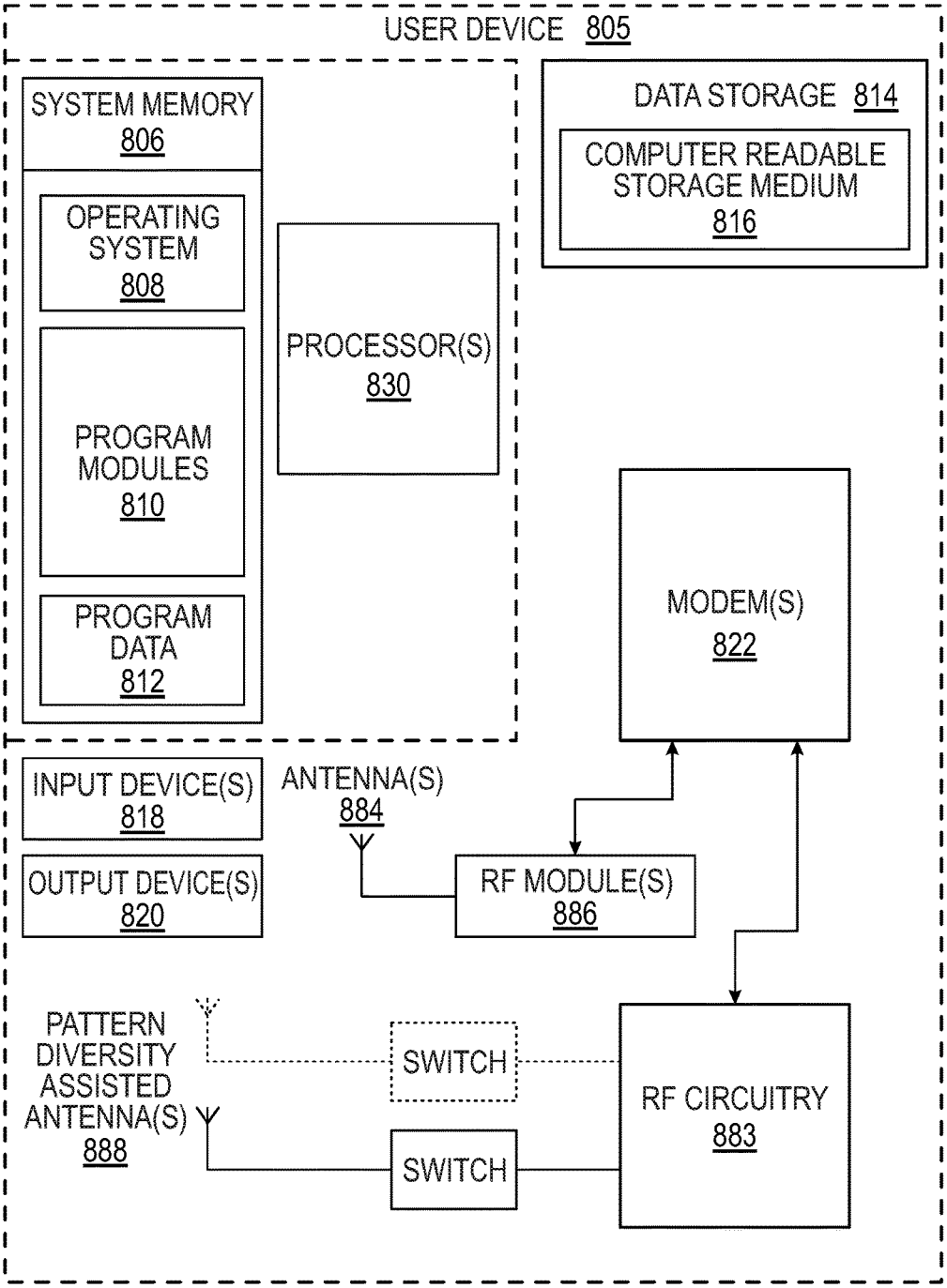
FIG. 12 is a block diagram of a user device in which embodiments of a cross-polarization antenna system on a single PCB may be implemented.

FIG. 12 is a block diagram of a user device 805 in which embodiments of a pattern diversity assisted antenna may be implemented. The user device 805 may correspond to the user device 100 of FIG. 1, the user device 200 of FIGS. 2A-2D, or the user device 900 of FIG. 9. The user device 805 may be any type of computing device such as an electronic book reader, a PDA, a mobile phone, a laptop computer, a portable media player, a tablet computer, a camera, a video camera, a netbook, a desktop computer, a gaming console, a DVD player, a computing pad, a media center, and the like. The user device 805 may be any portable or stationary user device. For example, the user device 805 may be an intelligent voice control and speaker system. Alternatively, the user device 805 can be any other device used in a WLAN network (e.g., Wi-Fi® network), a WAN network, or the like.

The user device 805 includes one or more processor(s) 830, such as one or more CPUs, microcontrollers, field programmable gate arrays, or other types of processors. The user device 805 also includes system memory 806, which may correspond to any combination of volatile and/or non-volatile storage mechanisms. The system memory 806 stores information that provides operating system component 808, various program modules 810, program data 812, and/or other components. In one embodiment, the system memory 806 stores instructions of the methods as described herein. The user device 805 performs functions by using the processor(s) 830 to execute instructions provided by the system memory 806.

The user device 805 also includes a data storage device 814 that may be composed of one or more types of removable storage and/or one or more types of non-removable storage. The data storage device 814 includes a computer-readable storage medium 816 on which is stored one or more sets of instructions embodying any of the methodologies or functions described herein. Instructions for the program modules 810 may reside, completely or at least partially, within the computer-readable storage medium 816, system memory 806 and/or within the processor(s) 830 during execution thereof by the user device 805, the system memory 806 and the processor(s) 830 also constituting computer-readable media. The user device 805 may also include one or more input devices 818 (keyboard, mouse device, specialized selection keys, etc.) and one or more output devices 820 (displays, printers, audio output mechanisms, etc.).

The user device 805 further includes a modem 822 to allow the user device 805 to communicate via a wireless network (e.g., such as provided by the wireless communication system) with other computing devices, such as remote computers, an item providing system, and so forth. The modem 822 can be connected to RF circuitry 883 and zero or more RF modules 886. The RF circuitry 883 may be a WLAN module, a WAN module, PAN module, or the like. Antennas 888 are coupled to the RF circuitry 883, which is coupled to the modem 822. Zero or more antennas 884 can be coupled to one or more RF modules 886, which are also connected to the modem 822. The zero or more antennas 884 may be GPS antennas, NFC antennas, other WAN antennas, WLAN or PAN antennas, or the like. The modem 822 allows the user device 805 to handle both voice and non-voice communications (such as communications for text messages, multimedia messages, media downloads, web browsing, etc.) with a wireless communication system. The modem 822 may provide network connectivity using any type of mobile network technology including, for example, cellular digital packet data (CDPD), general packet radio service (GPRS), EDGE, universal mobile telecommunications system (UMTS), 1 times radio transmission technology (1×RTT), evaluation data optimized (EVDO), high-speed down-link packet access (HSDPA), Wi-Fi®, Long Term Evolution (LTE) and LTE Advanced (sometimes generally referred to as 4G), etc.

The modem 822 may generate signals and send these signals to antenna 888, and 884 via RF circuitry 883, and RF module(s) 886 as descried herein. User device 805 may additionally include a WLAN module, a GPS receiver, a PAN transceiver and/or other RF modules. These RF modules may additionally or alternatively be connected to one or more of antennas 884, 888. Antennas 884, 888 may be configured to transmit in different frequency bands and/or using different wireless communication protocols. The antennas 884, 888 may be directional, omnidirectional, or non-directional antennas. In addition to sending data, antennas 884, 888 may also receive data, which is sent to appropriate RF modules connected to the antennas.

In one embodiment, the user device 805 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna element and the second wireless connection is associated with a second antenna element. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a modem 822 is shown to control transmission and reception via antenna (884, 888), the user device 805 may alternatively include multiple modems, each of which is configured to transmit/receive data via a different antenna and/or wireless transmission protocol.

The user device 805 delivers and/or receives items, upgrades, and/or other information via the network. For example, the user device 805 may download or receive items from an item providing system. The item providing system receives various requests, instructions and other data from the user device 805 via the network. The item providing system may include one or more machines (e.g., one or more server computer systems, routers, gateways, etc.) that have processing and storage capabilities to provide the above functionality. Communication between the item providing system and the user device 805 may be enabled via any communication infrastructure. One example of such an infrastructure includes a combination of a wide area network (WAN) and wireless infrastructure, which allows a user to use the user device 805 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 805.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 805 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 805 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

a radio disposed on a printed circuit board (PCB);

a processing device disposed on the PCB; and a first antenna comprising:

a radio frequency (RF) feed coupled to the radio;

a first ground element disposed on the PCB;

a first ground-extension bracket physically coupled to the PCB and electrically coupled to the first ground element, wherein the first ground-extension bracket extends from the PCB in a second plane that is orthogonal to a first plane of the PCB; and a first radiating element disposed on the PCB and coupled to the RF feed, the first radiating element oriented linearly with respect to a length of the first ground-extension bracket within the second plane, wherein the processing device applies a first signal to the RF feed that causes the first radiating element to radiate electromagnetic energy in a first radiation pattern; and a second antenna comprising:

a second RF feed coupled to the radio;

a second ground element disposed on the PCB;

a second ground-extension bracket physically coupled to the PCB and electrically coupled to the second ground element, wherein the second ground-extension bracket extends from the PCB in a third plane that is orthogonal to the first plane of the PCB and to the second plane of the first ground-extension bracket; and a second radiating element disposed on the PCB and coupled to the second RF feed, the second radiating element oriented linearly with respect to a length of the second ground-extension bracket within the third plane, wherein the processing device applies a second signal to the second RF feed that causes the second radiating element to radiate electromagnetic energy in a second radiation pattern, wherein the first radiation pattern and the second radiation pattern collectively form a cross-polarization radiation pattern.

2. The electronic device of claim 1, further comprising:

a third antenna comprising:

a third RF feed coupled to the radio;

a third ground element disposed on the PCB;

a third ground-extension bracket coupled to the PCB and electrically coupled to the third ground element, wherein the third ground-extension bracket extends from the PCB in a fourth plane that is orthogonal to the first plane of the PCB; and a third radiating element disposed on the PCB and coupled to the third RF feed, the third radiating element oriented linearly with respect to a length of the third ground-extension bracket within the fourth plane, wherein the processing device applies a third signal to the third RF feed that causes the third radiating element to radiate electromagnetic energy in a third radiation pattern; and a fourth antenna comprising:

a fourth RF feed coupled to the radio;

a fourth ground element disposed on the PCB;

a fourth ground-extension bracket coupled to the PCB and electrically coupled to the fourth ground element, wherein the fourth ground-extension bracket extends from the PCB in a fifth plane that is orthogonal to the first plane of the PCB and to the fourth plane of the third ground-extension bracket; and a fourth radiating element disposed on the PCB and coupled to the fourth RF feed, the fourth radiating element oriented linearly with respect to a length of the fourth ground-extension bracket within the fifth plane, wherein the processing device applies a fourth signal to the fourth RF feed that causes the fourth radiating element to radiate electromagnetic energy in a fourth radiation pattern, wherein the third radiation pattern and the fourth radiation pattern collectively form a cross-polarization radiation pattern.

3. The electronic device of claim 2, wherein the second plane corresponds to a first edge of the PCB, the fourth plane corresponds to a second edge of the PCB that is opposite to the first edge, and wherein the third plane and the fifth plane are identical and correspond to a third edge of the PCB that is located between the first edge and the second edge.

4. The electronic device of claim 1, wherein the first radiation pattern is at a first angle of polarization with respect to the first plane of the PCB and set by a height of the first ground-extension bracket, the second radiation pattern is at a second angle of polarization with respect to the first plane of the PCB and set by a height of the second ground-extension bracket, wherein the first angle is acute and angled towards the first ground-extension bracket and the second angle is acute and angled towards the second ground-extension bracket.

5. An apparatus comprising:
a circuit board; and
an antenna comprising:
a ground element disposed on the circuit board;
a ground-extension bracket coupled to the ground element, the ground-extension bracket oriented orthogonally to the circuit board; and
a radiating element disposed on the circuit board, the radiating element oriented linearly with respect to the ground-extension bracket, wherein the antenna, in response to a radio frequency (RF) signal, is configured to radiate electromagnetic energy in a radiation pattern at an angle of polarization with respect to a plane of the circuit board, wherein the angle of polarization is acute and angled towards the ground-extension bracket.

6. The apparatus of claim 5, wherein the ground element is located at a first end of the radiating element along a first edge of the circuit board, and the angle of polarization is acute with respect to the circuit board.

7. The apparatus of claim 5, wherein the ground element is located at a first end of the radiating element along a first edge of the circuit board, and the angle of polarization is obtuse with respect to the circuit board.

8. The apparatus of claim 5, wherein the ground-extension bracket has a height that results in the angle of polarization being approximately 45 degrees.

9. The apparatus of claim 5, wherein the circuit board comprises an isolation region comprising a dielectric material, the antenna is disposed at least partially within the isolation region, and wherein the ground element is disposed over less than all of a surface area of the circuit board.

10. The apparatus of claim 5, wherein the ground-extension bracket defines a horizontal slot that extends from a first edge of the ground-extension bracket to a middle of the ground-extension bracket, wherein the apparatus further comprises:
a switch coupled across the horizontal slot;
a control line coupled to the switch, the control line to carry a control signal to open or close the switch, to adjust the angle of polarization; and
a processing device disposed on the circuit board and coupled to the antenna, the processing device to control the angle of polarization with the control signal.

11. The apparatus of claim 5, further comprising a second antenna comprising:
a second ground element disposed on the circuit board;
a second ground-extension bracket coupled to the ground element, the ground-extension bracket oriented orthogonally to the circuit board; and
a second radiating element disposed on the circuit board, the second radiating element oriented linearly with respect to the second ground-extension bracket, wherein the second antenna is configured to radiate electromagnetic energy in a second radiation pattern at a second angle of polarization with respect to the plane of the circuit board, wherein the second radiating element is oriented orthogonal to the radiating element and located on an adjacent edge of the circuit board from the radiating element.

12. The apparatus of claim 5, wherein a height of the ground-extension bracket is (i) about 9 millimeters (mm) and wherein the radiating element radiates electromagnetic energy at approximately 5 GHz or (ii) about 21 mm and wherein the radiating element radiates electromagnetic energy at approximately 2.4 GHz.

13. An electronic device comprising:
a circuit board; and
an antenna comprising:
a ground element disposed on the circuit board;
a ground-extension bracket coupled to the ground element, the ground-extension bracket oriented orthogonally to the circuit board and comprising a first horizontal slot that extends from a first edge of the ground-extension bracket past a middle of the ground-extension bracket, and a second horizontal slot that extends from a second edge of the ground-extension bracket to past the middle of the ground-extension bracket;
a first switch coupled across the first horizontal slot and having a first state;
a second switch coupled across the second horizontal slot and having a second state; and
a radiating element disposed on the circuit board, the radiating element oriented linearly with respect to the ground-extension bracket, wherein the antenna is configured to radiate electromagnetic energy in a radiation pattern at a first angle of polarization with respect to a plane of the circuit board when the first switch is in a first state and the second switch is in a first state, and wherein the antenna is configured to radiate electromagnetic energy in the radiation pattern at a second angle of polarization with respect to the plane when at least one of the first state of the first switch or the first state of the second switch is changed.

14. The electronic device of claim 13, wherein the second angle of polarization is one of three possible angles derived from the first switch being in a second state, the second switch being in the second state, or both.

15. The electronic device of claim 13, further comprising:
a processing device disposed on the circuit board;
a first control line coupled to the first switch and electronically coupled to the processing device, wherein the processing device is configured to send a first control signal through the first control line to set the first state of the first switch; and
a second control line coupled to the second switch and electronically coupled to the processing device, wherein the processing device is configured to send a second control signal through the second control line to set the first state of the second switch.

16. The electronic device of claim 13, further comprising a second antenna comprising:
a second ground element disposed on the circuit board;
a second ground-extension bracket coupled to the ground element, the ground-extension bracket oriented orthogonally to the circuit board; and
a second radiating element disposed on the circuit board, the second radiating element oriented linearly with respect to the second ground-extension bracket, wherein the second antenna is configured to radiate electromagnetic energy in a second radiation pattern at a third angle of polarization with respect to the plane of the circuit board, wherein the second radiating element is oriented orthogonal to the radiating element and located on an adjacent edge of the circuit board from the radiating element.

17. The electronic device of claim 16, wherein the first angle of polarization is acute and angled towards the ground-extension bracket and the third angle of polarization is rotated 90 degrees with respect to the first angle of polarization, such that the radiation pattern and the second radiation pattern collectively form a cross-polarization radiation pattern.

18. The electronic device of claim 17, wherein the first angle of polarization is approximately 45 degrees.

19. The electronic device of claim 16, wherein the radiating element is disposed adjacent a first end of the ground element along a first edge of the circuit board, and the second radiating element is disposed adjacent a second end of the second ground element along the adjacent edge of the circuit board, such that the radiation pattern and the second radiation pattern collectively form a multi-polarization radiation pattern.

20. The electronic device of claim 16, wherein the ground-extension bracket and the second ground-extension bracket have a height of between approximately 9 mm and approximately about 21 mm.

* * * * *